US007300125B2

(12) United States Patent
Iwao et al.

(10) Patent No.: US 7,300,125 B2
(45) Date of Patent: Nov. 27, 2007

(54) INKJET HEAD PRINTING DEVICE

(75) Inventors: Naoto Iwao, Nagoya (JP); Atsuo Sakaida, Gifu (JP); Hiroshi Taira, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 79 days.

(21) Appl. No.: 10/913,490

(22) Filed: Aug. 9, 2004

(65) Prior Publication Data

US 2005/0035986 A1 Feb. 17, 2005

(30) Foreign Application Priority Data

Aug. 14, 2003 (JP) ..... 2003-293544

(51) Int. Cl.
*B41J 29/38* (2006.01)
*B41J 2/205* (2006.01)
*B41J 2/045* (2006.01)

(52) U.S. Cl. ..... 347/10; 347/15; 347/71

(58) Field of Classification Search ..... 347/68
See application file for complete search history.

(56) References Cited

U.S. PATENT DOCUMENTS 5,402,159 A 3/1995 Takahashi et al.
5,831,650 A * 11/1998 Reinten ..... 347/68
6,273,539 B1 * 8/2001 Suzuki ..... 347/12
6,290,315 B1 * 9/2001 Sayama ..... 347/10
6,331,052 B1 12/2001 Murai et al.
6,371,599 B1 4/2002 Hotomi et al.
6,428,134 B1 * 8/2002 Clark et al. ..... 347/10
6,460,959 B1 * 10/2002 Momose et al. ..... 347/11
6,460,979 B1 * 10/2002 Heinzl et al. ..... 347/68
6,471,316 B1 10/2002 Seto
6,488,349 B1 12/2002 Matsuo et al.
6,953,241 B2 * 10/2005 Sakaida et al. ..... 347/68

FOREIGN PATENT DOCUMENTS

JP A 58-62063 4/1983
JP A 04-341852 11/1992
JP A 11-157076 6/1999
JP A 11-300955 11/1999
JP A 2000-168071 6/2000
JP A-2001-158115 6/2001
JP A-2003-165215 6/2003

* cited by examiner

*Primary Examiner*—Matthew Luu
*Assistant Examiner*—Shelby Fidler
(74) *Attorney, Agent, or Firm*—Oliff & Berridge, PLC

(57) ABSTRACT

There is provided an inkjet head printing device, which includes an inkjet head having an ink flow channel unit and a piezoelectric actuator unit, and a pulse generator that determines first pulse patterns to be applied to electrodes respectively corresponding to nozzles determined to eject the ink, each of the first pulse patterns having a first potential which causes each of the plurality of nozzles to eject the ink. The pulse generator further determines a second pulse pattern to be applied to at least one of electrodes respectively corresponding to nozzles determined not to eject the ink, the second pulse pattern having a second potential which does not cause each of the plurality of nozzles to eject the ink.

24 Claims, 15 Drawing Sheets

INKJET HEAD PRINTING DEVICE

BACKGROUND OF THE INVENTION

The present invention relates to an inkjet head printing device having an inkjet head for ejecting ink to a sheet of paper.

One of various types of conventional inkjet heads employed in the inkjet head printing device such as an inkjet printer is configured to have a fluid channel unit and an actuator unit. The fluid channel unit has a plurality of pressure chambers and a plurality of nozzles provided respectively for the plurality of pressure chambers. Ink introduced into the pressure chambers are ejected from the nozzles to form an image on the sheet of paper by selectively applying pressure to the pressure chambers using the actuator unit.

The actuator unit has a laminated structure consisting of a plurality of piezoelectric sheets and a common electrode layer. Further, a plurality of small electrodes are formed on one of the piezoelectric sheets for the plurality of the pressure chambers. The common electrode layer is maintained at a ground level. One of the piezoelectric sheets sandwiched between the common electrode layer, and the plurality of small electrodes is used as an active layer that is distorted when a voltage is applied thereto to apply presser to the pressure chambers.

The piezoelectric sheet has been polarized in a direction of its thickness. If a voltage is applied between the small electrode and the common electrode, the voltage is applied to a portion of the piezoelectric sheet (i.e., the active layer) in a direction of polarization of the piezoelectric sheet. Therefore, the portion of the piezoelectric sheet expands/contracts in the direction of its thickness by a vertical piezoelectric effect, which applies pressure to the pressure chamber to eject the ink from the nozzle.

It is desired to arrange the nozzles on the inkjet head more densely to increase resolution of images and/or to improve printing speeds. However, if the density of the nozzle is increased, i.e., the density of the pressure chambers is increased, a problem, that the amount of ejection of ink improperly increases or decreases relative to an appropriate of amount of ejection of the ink, or pressure chambers surrounding a target pressure chamber which is being applied with pressure are distorted by neighboring electrodes, occurs. Such a problem is frequently called a structural crosstalk. If the structural crosstalk occurs, quality of the image is deteriorated.

Japanese Patent Provisional Publication No. HEI 11-157076 discloses an inkjet head having a configuration for suppressing an effect of the structural crosstalk. According to the inkjet head disclosed in this publication, when a voltage is applied to a portion of a piezoelectric sheet corresponding to a target pressure chamber, which is targeted for application of pressure, a certain level of pressure which does not cause the nozzle to eject ink is also applied to neighboring pressure chambers surrounding the target pressure chamber.

According to the above mentioned configuration of the inkjet head disclosed in the publication, all of the pressure chambers are uniformly affected by their neighboring pressure chambers. Such configuration of the inkjet head enables to uniform the effects, caused by the structural crosstalk, on all of the nozzles of the inkjet head. Consequently, the amounts of the ink ejected from the nozzles become uniform, and thereby deterioration of the image is prevented.

However, in the publication, there is no explanation on how to control the inkjet head to represent gray scale on the image while suppressing the effect of the structural crosstalk.

SUMMARY OF THE INVENTION

The present invention Is advantageous in that it provides an inkjet head printing device which uniforms effects, caused by a structural crosstalk, on ejection of ink from nozzles when control for representing gray scale is performed.

According to an aspect of the invention, there is provided an inkjet head printing device, which is provided with an inkjet head that has an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles. The inkjet head printing device is further provided with a pulse generator that determines whether each of the plurality of nozzles ejects the ink or not, and determines an amount of ink to be ejected from each of the plurality of nozzles based on gray scale information in image data to be formed.

In this structure, the pulse generator determines first pulse patterns to be applied to electrodes respectively corresponding to nozzles determined to eject the ink by the pulse generator, the first pulse patterns respectively corresponding to amounts of ink of the nozzles determined to eject the ink by the pulse generator, each of the first pulse patterns having a first potential which causes each of the plurality of nozzles to eject the link. The pulse generator determines a second pulse pattern to be applied to at least one of electrodes respectively corresponding to nozzles determined not to eject the ink by the pulse generator, the second pulse pattern having a second potential which does not cause each of the plurality of nozzles to eject the ink.

With this configuration, effects of the structural crosstalk on the nozzles determined to eject the ink can be uniformed over the entire region of each actuator unit, and thereby it becomes possible to represent gray scale while preventing the deterioration of the image by the structural crosstalk.

Optionally, a number of pulses contained in each of the first pulse patterns and a number of pulses contained in the second pulse pattern may be determined based on the gray scale information in the image data.

In a particular case, at least one of a number of pulses contained in the second pulse pattern, a cycle of a pulse contained in the second pulse pattern, and a phase of the pulse contained in the second pulse pattern may be the same as that of one of the first pulse patterns.

In a particular case, at least one of a number of pulses, a cycle of a pulse and a phase of the pulse in the second pulse pattern may be predetermined.

In a particular case, the second pulse pattern may be determined based on the densest gray scale level of gray scale levels of pixels in the image data.

Optionally, the inkjet head printing device may include a memory that stores a plurality of kinds of pulse patterns which respectively correspond to a plurality of kinds of gray scale levels. Further, the pulse generator may determine the first pulse patterns by selecting one of the plurality of kinds of patterns stored in the memory based on the gray scale information in the image data.

Still optionally, the pulse generator may determine the second pulse pattern based on the plurality of kinds of pulse patterns stored in the memory.

Still optionally, the second pulse pattern may be equal to one of the plurality of kinds of pulse patterns corresponding to the densest gray scale level of gray scale levels of the plurality of kinds of pulse patterns.

In a particular case, the pulse generator may determine a plurality of second pulse patterns, each having the second potential, for applying to all of the nozzles determined not to eject the ink.

Optionally, the pulse generator may determine a plurality of second pulse patterns, each having the second potential, for applying to the nozzles which are determined not to eject the ink and which adjoin to one of the nozzles determined to eject the ink.

Still optionally, one of the second pulse patterns for one of the nozzles determined not to eject the ink may be determined based on neighboring nozzles which are determined to eject the ink and which adjoin to the one of the nozzles determined not to eject the ink.

Still optionally, the one of the second pulse patterns for the one of the nozzles determined not to eject the ink may be determined by considering gray scale levels for all of the neighboring nozzles.

Still optionally, the one of the second pulse patterns for the one of the nozzles determined not to eject the ink may be determined in accordance with a densest gray scale level of gray scale levels of the neighboring nozzles.

In a particular case, the one of the second pulse patterns for the one of the nozzles determined not to eject the ink may be determined based on a portion of the neighboring nozzles having a certain positional relationship with the one of the nozzles determined not to eject the ink.

In a particular case, the one of the second pulse patterns for the one of the nozzles determined not to eject the ink may be determined based on a portion of the neighboring nozzles situated in a certain direction with respect to the one of the nozzles determined not to eject the ink.

Optionally, the certain direction may be a direction in which an effect of a structural crosstalk from the one of the nozzles determined not to eject the ink becomes greatest.

According to another aspect of the invention, there is provided an inkjet head printing device, which is provided with an inkjet head that has an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles.

Further, the inkjet head printing device is provided with a pulse generator that determines first pulse patterns to be applied to electrodes respectively corresponding to nozzles which are to eject the ink, each of the first pulse patterns having a number of pulses based on gray scale information of an image to be formed, each of the first pulse patterns having a first potential which causes each of the plurality of nozzles to eject the ink, the pulse generator further determining a second pulse pattern to be applied to at least one of electrodes respectively corresponding to nozzles which are not to eject the ink, the second pulse pattern having a second potential which does not cause each of the plurality of nozzles to eject the ink, a phase and a cycle of the second pulse pattern being the same as those of one of the first pulse patterns.

Further, the inkjet head printing device is provided with a pulse supplying unit that supplies the electrodes respectively corresponding to the nuzzles which are to eject the ink with the first pulse patterns, respectively, and supplies the at least one of electrodes respectively corresponding to nozzles which are not to eject the ink with the second pulse pattern.

With this configuration, effects of the structural crosstalk on the nozzles which are to eject the ink can be uniformed over the entire region of each actuator unit, and thereby it becomes possible to represent gray scale while preventing the deterioration of the image by the structural crosstalk.

According to another aspect of the invention, there is provided an inkjet head printing device, which is provided with an inkjet head that has an ink flow channel unit including a plurality of nozzles for ejecting ink, a plurality of ink flow channels respectively provided for the plurality of nozzles and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles.

Further, the inkjet head printing device is provided with a pulse generator that determines whether each of the plurality of ink flow channels ejects the ink or not, and determines an amount of ink to be ejected from each of the plurality of ink flow channels based on gray scale information in image data to be formed.

In this structure, the pulse generator determines first pulse patterns to be applied to electrodes respectively corresponding to ink flow channels determined to eject the ink by the pulse generator, the first pulse patterns respectively corresponding to amounts of ink of the ink flow channels determined to eject the ink by the pulse generator, each of the first pulse patterns having a first potential which causes each of the plurality of ink flow channels to eject the ink. The pulse generator determines a second pulse pattern to be applied to at least one of electrodes respectively corresponding to ink flow channels determined not to eject the ink by the pulse generator, the second pulse pattern having a second potential which does not cause each of the plurality of ink flow channels to eject the ink.

With this configuration, effects of the structural crosstalk on the nozzles which are to eject the ink can be uniformed over the entire region of each actuator unit, and thereby it becomes possible to represent gray scale while preventing the deterioration of the image by the structural crosstalk.

According to another aspect of the invention, there is provided a method of driving an inkjet head of an inkjet head printing device, the inkjet head having an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles. The method includes: determining whether each of the plurality of nozzles ejects the ink or not, and determining an amount of ink to be ejected from each of the plurality of nozzles based on gray scale information in image data to be formed; generating first pulse patterns to be applied to electrodes respectively corresponding to nozzles determined to eject the ink by the determining step, the first pulse patterns respectively corresponding to amounts of ink of the nozzles determined to eject the ink, each of the first pulse patterns having a first potential which causes each of the plurality of nozzles to eject the ink; and generating a second pulse pattern to be applied to at least one of electrodes respectively corresponding to nozzles determined not to eject the ink by the determining step, the second pulse pattern having a second potential which does not cause each of the plurality of nozzles to eject the ink.

With this configuration, effects of the structural crosstalk on the pressure chambers determined to eject the ink can be uniformed over the entire region of each actuator unit, and thereby it becomes possible to represent gray scale while preventing the deterioration of the image by the structural crosstalk.

In a particular case, a number of pulses contained in each of the first pulse patterns and a number of pulses contained in the second pulse pattern may be determined based on the gray scale information in the image data.

In a particular case, at least one of a number of pulses contained in the second pulse pattern, a cycle of a pulse contained in the second pulse pattern, and a phase of the pulse contained in the second pulse pattern may be the same as that of one of the first pulse patterns.

In a particular case, the second pulse pattern may be determined based on the densest gray scale level of gray scale levels of pixels in the image data.

According to another aspect of the invention, there is provided a method of driving an inkjet head of an inkjet head printing device, the inkjet head having an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles. The method includes: determining whether each of the plurality of nozzles ejects the ink or not, and determining an amount of ink to be ejected from each of the plurality of nozzles based on gray scale information in image data to be formed; and generating first pulse patterns to be applied to electrodes respectively corresponding to nozzles determined to eject the ink by the determining step, the first pulse patterns respectively corresponding to amounts of ink of the nozzles determined to eject the ink, each of the first pulse patterns having a first potential which causes each of the plurality of nozzles to eject the ink.

Further, the method includes: determining whether each of the nozzles determined not to eject the ink adjoins to at least one nozzle determined to eject the ink; and when one of the nozzles determined not to eject the ink adjoins to the at least one nozzle determined to eject the ink, generating a second pulse pattern to be applied to one of the electrodes corresponding to the one of the nozzles determined not to eject the ink in accordance with a densest gray scale level of gray scale levels of the at least one nozzle determined to eject the ink, the second pulse pattern having a second potential which does not cause each of the plurality of nozzles to eject the ink.

With this configuration, effects of the structural crosstalk on the nozzles determined to eject the ink can be uniformed over the entire region of each actuator unit, and thereby it becomes possible to represent gray scale while preventing the deterioration of the image by the structural crosstalk.

The device and method according to the present invention can be realized when appropriate programs are provided and executed by a computer. Such programs may be stored in recording medium such as a flexible disk, CD-ROM, memory cards and the like and distributed. Alternatively or optionally, such programs can be distributed through networks such as the Internet.

BRIEF DESCRIPTION OF THE ACCOMPANYING DRAWINGS

FIG. 1 schematically shows an inkjet printer according to a first embodiment of the invention;

DETAILED DESCRIPTION OF THE EMBODIMENTS

First Embodiment

Figure 1:
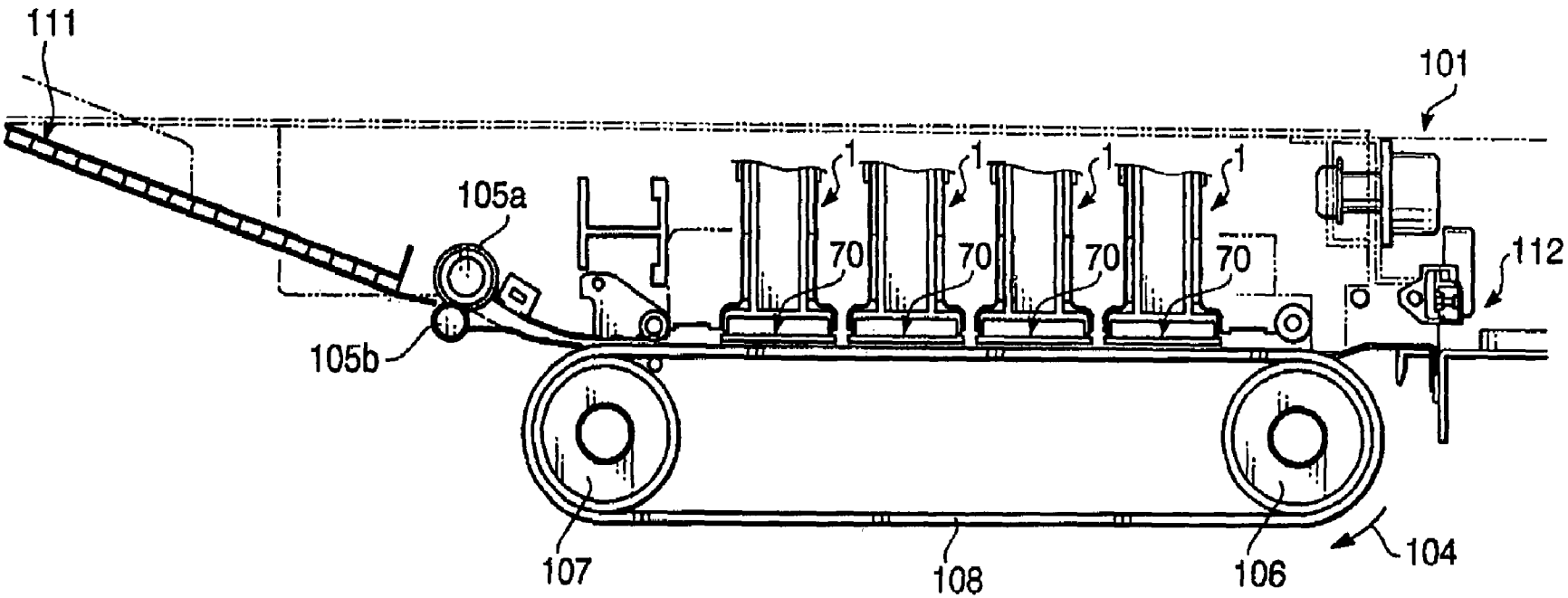

FIG. 1 schematically shows an inkjet printer 101 according to a first embodiment of the invention. As shown in FIG. 1, the inkjet printer 101 has four inkjet heads 1 for forming color images. In the inkjet printer 101, a sheet feeding unit 111 is located on an upstream side of a sheet feed path, and a sheet ejecting portion 112 is located on a downstream side of the sheet feed path. As described in detail below, the inkjet printer 101 has a control unit 113 which controls operation of the inkjet heads 1.

As shown in FIG. 1, along the sheet feed path, a pair of sheet feed rollers 105*a* and 105*b* is located immediately on the downstream side of the sheet feeding unit 111. By the pair of sheet feed rollers 105*a* and 105*b*, the sheet is fed from the sheet feeding unit 111 into the inside of the inkjet printer 101.

At a midway of the sheet feed path, a carrying belt 108 which is driven by belt rollers 106 and 107 is located. An outer surface of the carrying belt 108 has been processed by a silicon coating. Therefore, the sheet fed into the inside of the inkjet printer 101 is carried along the sheet feed path toward the downstream side by rotations of the belt roller 106 in a direction of allow 104 (see FIG. 1) while the sheet is being held on the outer surface of the carrying belt 108 by adhesive properties of the outer surface of the carrying belt 108.

Each of the inkjet heads 1 has a head body 70 having a rectangular form when it is viewed as a plan view. The inkjet heads 1 are located such that longitudinal sides thereof are substantially perpendicular to a direction of the sheet feed path, and that they are adjacent to one another. Each of the inkjet heads 1 has a bottom surface facing the sheet feed path. On the bottom surface of the inkjet head 1, a plurality of nozzles 8 for ejecting ink are formed (see FIG. 5). The four head bodies 70 eject ink having colors of magenta, yellow, cyan and black, respectively.

Each of the head bodies 70 and the carrying belt 108 are located closely to have a clearance between them. The clearance constitutes the sheet feed path. When the sheet is positioned, along the sheet feed path, immediately below each of the head bodies 70, the ink having the corresponding color is ejected from the nozzles of each head body 70 to the sheet. Consequently, a color image or a monochrome gray scale image can be formed on the sheet.

Figure 2:
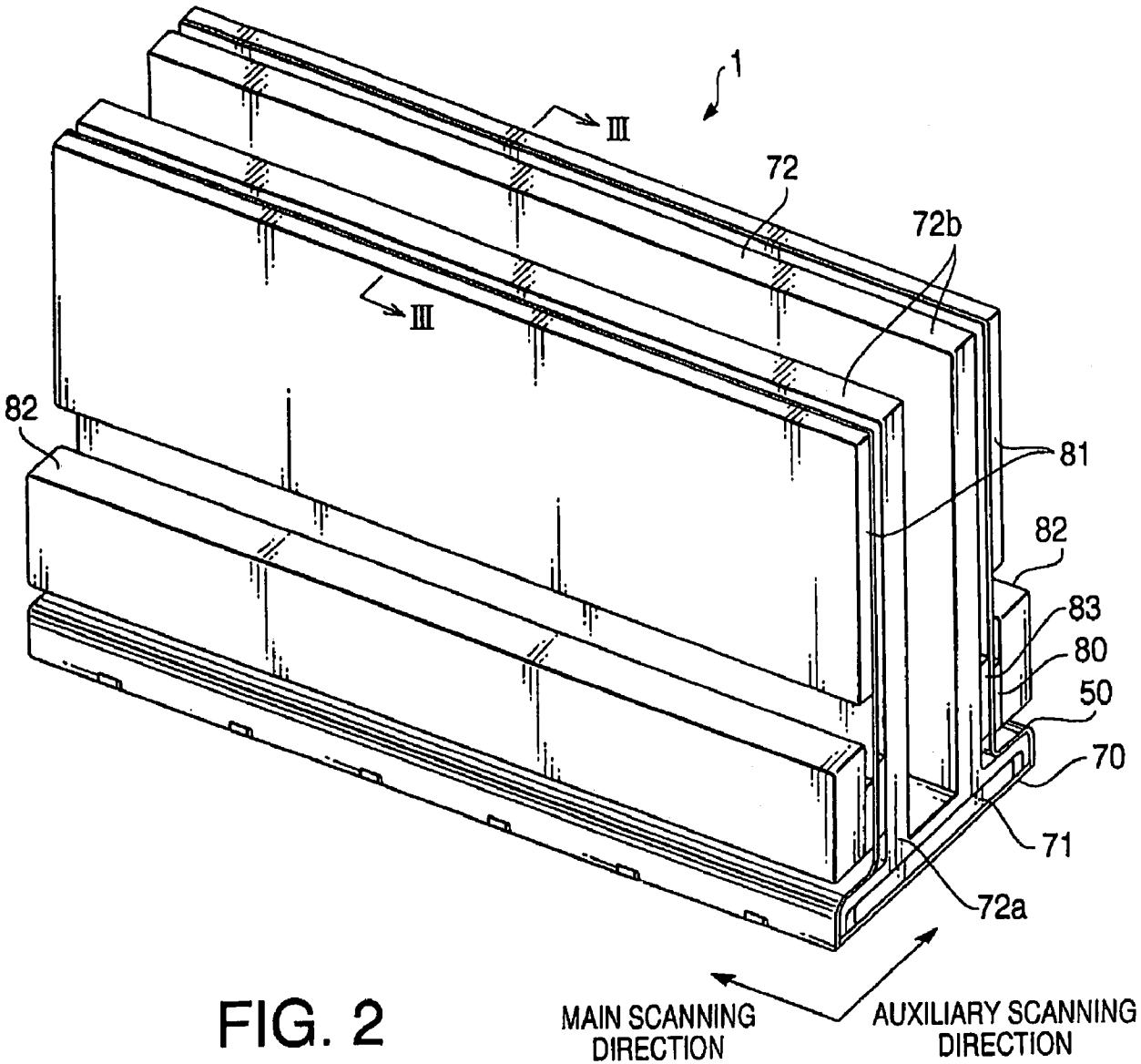
FIG. 2 is a perspective view of an inkjet head of the inkjet printer.
Figure 3:
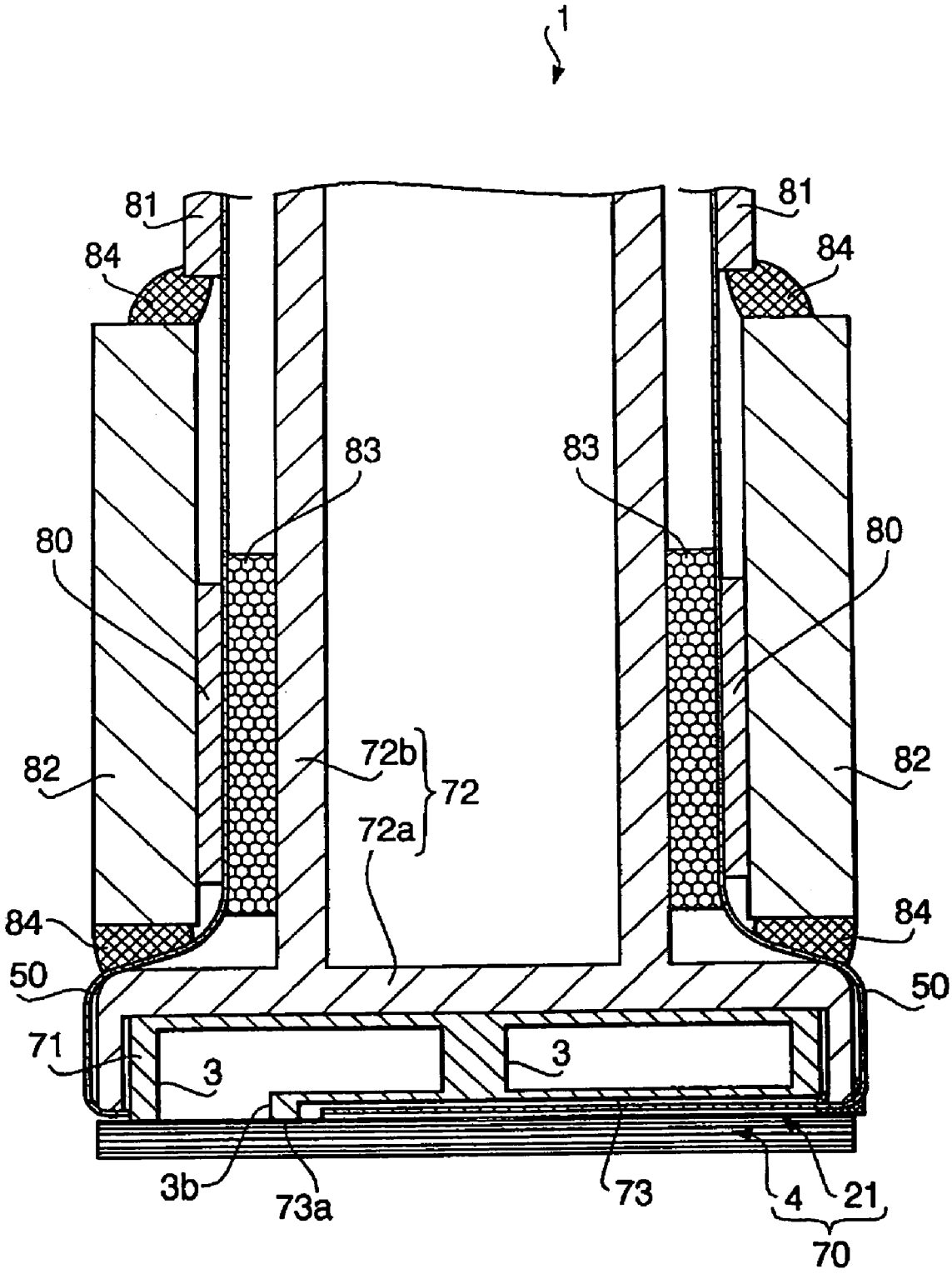
FIG. 3 is a cross sectional view of the inkjet head shown in FIG. 2.

Hereafter, a configuration of the inkjet head 1 will be described in detail. FIG. 2 is a perspective view of the inkjet head 1. FIG. 3 is a cross sectional view of the inkjet head 1 when it is cut along a line III-III indicated in FIG. 2. As shown in FIG. 2, the inkjet head 1 includes the head body 70 having the rectangular form elongated in a main scanning direction (which is perpendicular to the direction of the sheet feed path), and a base block 71 located on the top surface of the head body 70. In the base block 71, two ink reservoirs 3 are formed to supply the head body 70 with ink. Each ink reservoir 3 has a form of a box elongated along the longitudinal side of the rectangular form of the head body 70.

As described in detail later, the head body 70 has an ink flow channel unit 4 in which ink flow channels are formed, and a plurality of actuator units 21 (see FIG. 4). Each of the ink flow channel unit 4 and the actuator unit 21 has a laminated structure composed of a plurality of thin plates adhered to one another.

On an outer region of a holder 72, FPCs (flexible printed circuit) 50 are provided. Each FPC 50 is located on the outer region of the holder 72 via an elastic member 83. The FPC 50 is bent at corners of a holding portion 72*a* of the holder 72, and is inserted into a gap between the base block 71 and head body 70 to be electrically connected to each actuator unit 21.

More specifically, as shown in FIG. 3, the base block 71 has an opening 3*b*. A bottom surface 73 of the base block 71 contacts the head body 70 only at a portion 73*a* situated in the vicinity of the opening 3*b*. That is, between the top surface of the head body 70 and the bottom surface 73 except a region of the opening 3*b*, the gap is formed. Each actuator unit 21 is located in the gap.

As shown in FIG. 2, the base block 71 is adhered to a concave portion of the holding portion 72*a* of the holder 72. The holder 72 further has a pair of protrusions 72*b* arranged to have a certain interval. Each of the protrusions 72*b* has a form elongated in a direction perpendicular to a top surface of the holding portion 72*a*.

On an outer surface of the FPC 50, a driver IC 80 is mounted. The FPC 50 is soldered to the driver IC 80 and the actuator unit 21 to electrically connect the driver IC 80 to the actuator unit 21. Driving signals are transmitted from the driver IC 80 to the actuator unit 21.

Further, the inkjet head 1 has heatsinks 82. The heatsinks 82 are arranged such that an inner surface of the heatsiink 82 and an outer surface of the driver IC 80 are kept in absolute contact with each other. With this structure heat generated by the driver IC 80 is dissipated into the atmosphere. On an upper side of the heatsink 82, a printed circuit board 81 is located. The printed circuit board 81 is also mounted on the FPC 50 to be electrically connected to the driver IC 80. Further, shield members 84 are located between the printed circuit board 81 and the top surface of the heatsink 82, and between a bottom surface of the heatsink 82 and the FPC 50.

As described in detail later, circuits on the printed circuit board 81 and the driver IC 80, which are connected via the FPC 50, constitute a pulse generator 200 (see FIG. 10) that generates pulses for driving the actuator unit 21. The pulse generator 200 communicates with the control unit 113 so as to transmit the driving pulses to the inkjet head 1. By the above mentioned structure of each inkjet head 1, the four, inkjet heads 1 emit the ink having their respective color components of magenta, yellow, cyan and black onto the sheet to form the color image.

Figure 4:
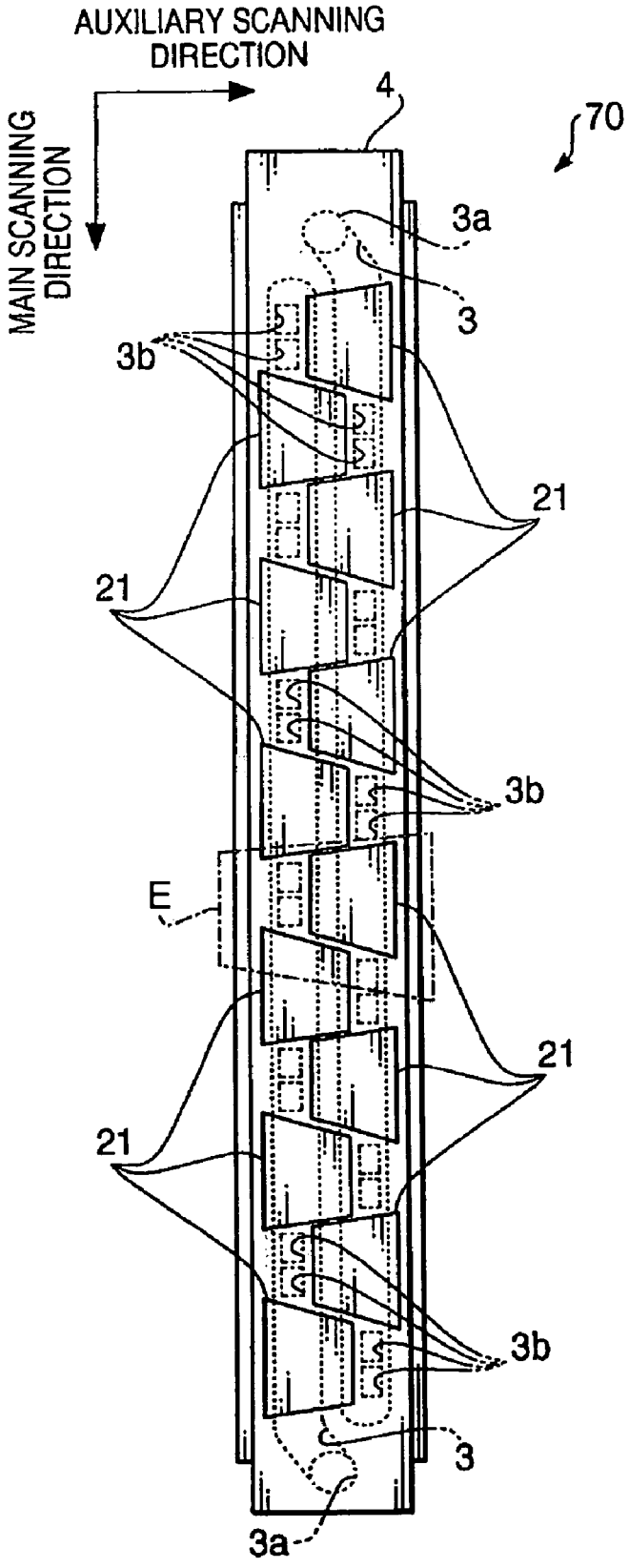
FIG. 4 is a plan view of a head body of the inkjet head.

FIG. 4 is a plan view of the head body 70. In FIG. 4, shapes of the ink reservoirs 3 are indicated by imaginary lines (dashed lines). Each ink reservoir 3 has an elongated form in a direction parallel with the longitudinal side of the head body 70. The two ink reservoirs 3 are arranged to have a predetermined interval between them.

Each ink reservoir 3 has an opening 3*a* at one end thereof, and communicates with an ink tank (not shown) through the opening 3*a*. Therefore, the ink reservoir 3 is constantly filled with the ink. As shown in FIG. 4, a plurality of openings 3*b* are formed on the base block 71 in pairs along each ink reservoir 3 so as to connect the ink reservoir 3 to the ink flow channel unit 4. The pairs of the openings 3*b*, situated on both of the ink reservoirs 3, are located on the head body 70 in a staggered arrangement.

As shown in FIG. 4, a plurality of actuator units 21 are also located on the head body 70 in a staggered arrangement so that each actuator unit 21 is opposed to the corresponding pair of openings 3*b* in a direction parallel with a shorter side of the rectangular form of the head body 70.

Each actuator unit 21 has a trapezoidal form whose upper and lower sides are parallel with the longitudinal side of the head body 70. Further, the actuator units 21 are located such that upper side portions thereof overlap one another in the direction parallel with the shorter side of the head body 70.

Figure 5:
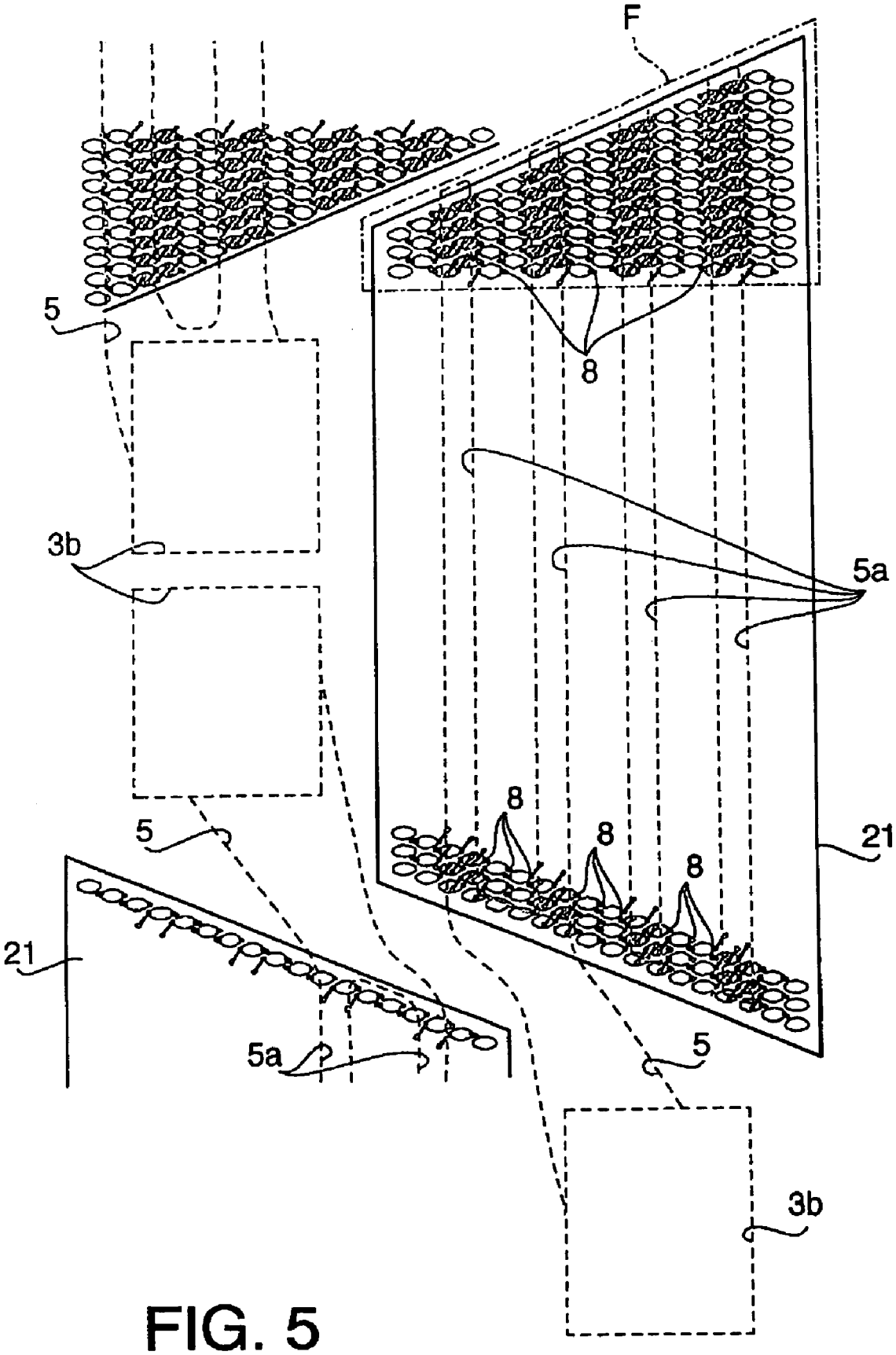
FIG. 5 is an enlarged view of a section of the head body shown in FIG. 4.

FIG. 5 is an enlarged view of a section E indicated in FIG. 4. As shown in FIG. 5, the openings 3*b* respectively communicate with manifolds 5, each of which used as a common ink room for the plurality of nozzles 8. Each manifold 5 branches off into two sub-manifolds 5*a*. In a region in which each actuator unit 21 lies, two pairs of sub-manifolds 5*a* (i.e., four sub-manifold 5*a*) are passed. Each pair of sub-manifolds 5*a* is connected to one of two openings 3*b* which are located adjacent to their respective oblique sides of each actuator unit 21.

On a portion of a bottom surface of the ink flow channel unit 4 opposed to a region in which one of the actuator units 21 lies, an ink ejecting area is formed. That is, a plurality of ink ejecting areas are formed on the bottom surface of the head unit 70 for the plurality of actuator units 21. Each ink ejecting area includes a plurality of nozzles 8 arranged in a matrix. In FIG. 5, a portion of the plurality of nozzles 8 are indicated for the sake of simplicity. In actuality, the nozzles are distributed in the entire trapezoidal ink ejecting area.

Figure 6:
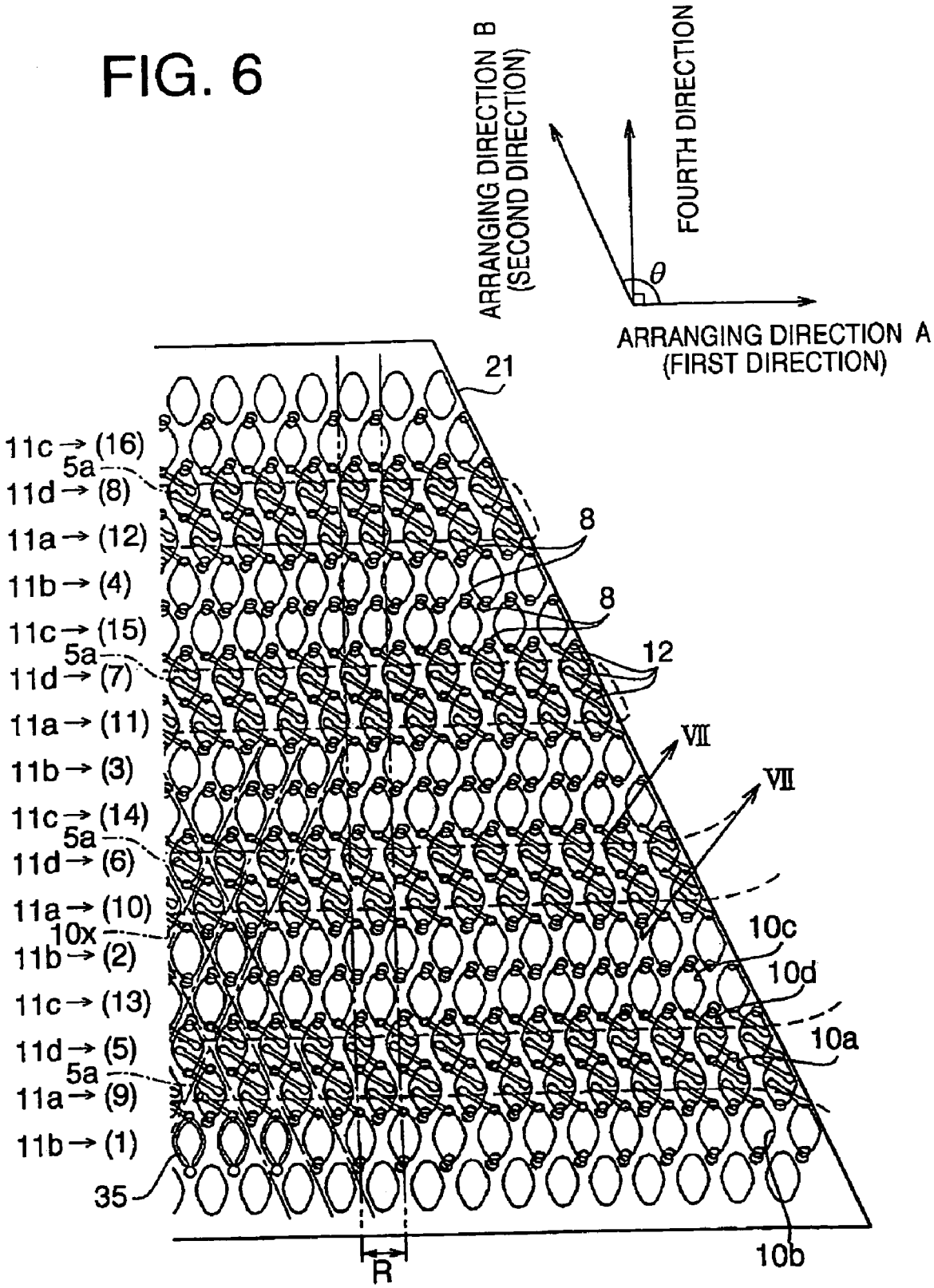
FIG. 6 is an enlarged view of a section of an actuator unit shown in FIG. 5.

FIG. 6 is an enlarged view of a section F indicated in FIG. 5. That is, FIG. 6 shows the head body 70 when it is viewed from the ink ejecting surface (i.e., the bottom surface) side. As shown in FIG. 6, a plurality of pressure chambers 10 are provided respectively for the plurality of nozzles 8. It should be noted that all of elements, including the plurality of pressure chambers 10 and a plurality of apertures 12, which are formed on different layers of the ink flow channel unit 4, are indicated by using a solid line for the sake of simplicity.

Each pressure chamber 10 has a rhombic form of which corners have round forms. The pressure chambers 10 are located within the ink ejecting area such that a longer diagonal line is parallel with the shorter side of the head body 70.

One end portion of each pressure chamber 10 communicates with the nozzle 8, and the other end portion of each pressure chamber 10 communicates with the sub-manifold 5*a*. As shown in FIG. 6, on the actuator unit 21, a plurality of electrodes 35 are provided respectively for the plurality of pressure chambers 10. Similarly to the pressure chamber 10, each electrode 35 has a rhombic form having a size slightly smaller than that of the pressure chamber 10. In FIG. 6, only some of the plurality of electrodes 35 are indicated for the sake of simplicity.

In FIG. 6, a plurality of imaginary areas 10*x*, each having a rhombic shape, are indicated for the explanation of an arrangement of the elements (i.e., the pressure chambers 10, individual electrodes 35, etc.). As shown in FIG. 6, the imaginary areas 10*x* are arranged such that four sides of one imaginary area 10 touch neighboring four imaginary areas 10*x* without the one imaginary area 19 and the neighboring four imaginary areas 10 overlapping one another.

The imaginary areas 10 are arranged in a matrix having an arranging direction A (a first direction) and an arranging direction B (a second direction). The arranging direction A is parallel with the longitudinal direction of the head body 70 and a shorter diagonal line of the rhombic shape of the imaginary area 10*x*. The arranging direction B forms an obtuse angle θ with respect to the arranging direction A.

The pressure chambers 10 are arranged in the arranging direction A to have predetermined intervals corresponding to, for example, 37.5 dpi (dots per inch). Eighteen pressure chambers 10 are arranged in the arranging direction B within each ink ejection area. The eighteen pressure chambers 10 arranged in the arranging direction B include two dummy pressure chambers located both end portions thereof. The dummy pressure chambers do not contribute to the ejection of the ink.

The pressure chambers 10 are categorized into four types of chamber rows 11*a*, 11*b*, 11*c* and 11*d* depending on a positional relationship with the sub-manifold 5*a* when they are viewed along a direction perpendicular to the bottom surface of the head body 70. Hereafter, the direction perpendicular to the bottom surface of the head body is referred to as a third direction, and a direction perpendicular to the first direction (the direction A) on the bottom surface of the head body 70 is referred to as a fourth direction.

Each chamber row is arranged in a line in the arranging direction A. The chamber rows are arranged, from the upper side, by four repetitions of a pattern of row 11*c*, row 11*d*, row 11*a* and row 11*b*.

With regard to pressure chambers 10*a* included in the chamber row 11*a* and pressure chambers 10*b* included in the chamber row 11*b*, the nozzle 8 of the pressure chamber is located at the lower end portion of the rhombic form of the pressure chamber. On the other hand, with regard to pressure chambers 10*c* included in the chamber row 11*c* and pressure chambers 10*d* included in the chamber row 11*d*, the nozzle 8 of the pressure chamber is located at the upper end portion of the rhombic form of the pressure chamber.

With regard to the chamber rows 11*a* and 11*d*, a portion of each pressure chamber (10*a* or 10*d*) overlaps the corresponding sub-manifold 5*a*. On the other hand, with regard to the chamber rows 11*b* and 11*c*, pressure chambers 10*b* and 10*d* are laid without overlapping the sub-manifold 5*a*.

With the above mentioned structure, it becomes possible to broaden the width of the sub-manifold 5*a* as broad as possible with keeping the nozzles 8 and the sub-manifold 5*a* from overlapping when they are viewed along the third direction. Therefore, a smooth ink flow to the pressure chamber 10 can be secured.

Figure 7:
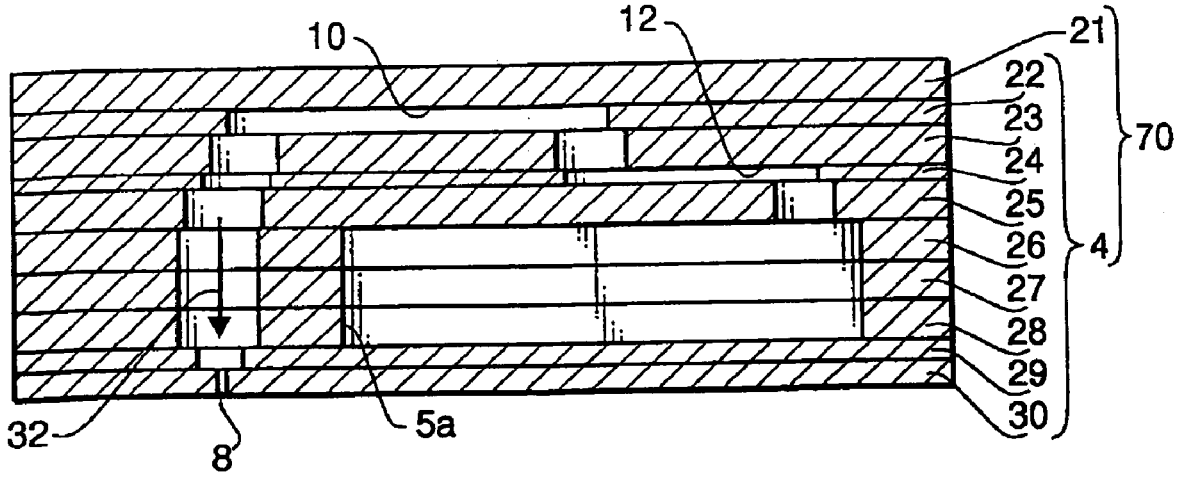
FIG. 7 Is a cross sectional view of the head body shown in FIG. 6.

Next, a structure of the head body 70 will be described in detail with reference to FIGS. 7 and 8. FIG. 7 is a cross sectional view of the head body 70 when it is cut along a line VII-VII indicated in FIG. 6. FIG. 7 shows the structure regarding the pressure chamber 10*a* included in the chamber row 11*a* by way of example. In FIG. 7, one ink flow channel 32 is illustrated. In actuality, a number of ink flow channels 32 are formed in the ink flow channel unit 4.

Figure 8:
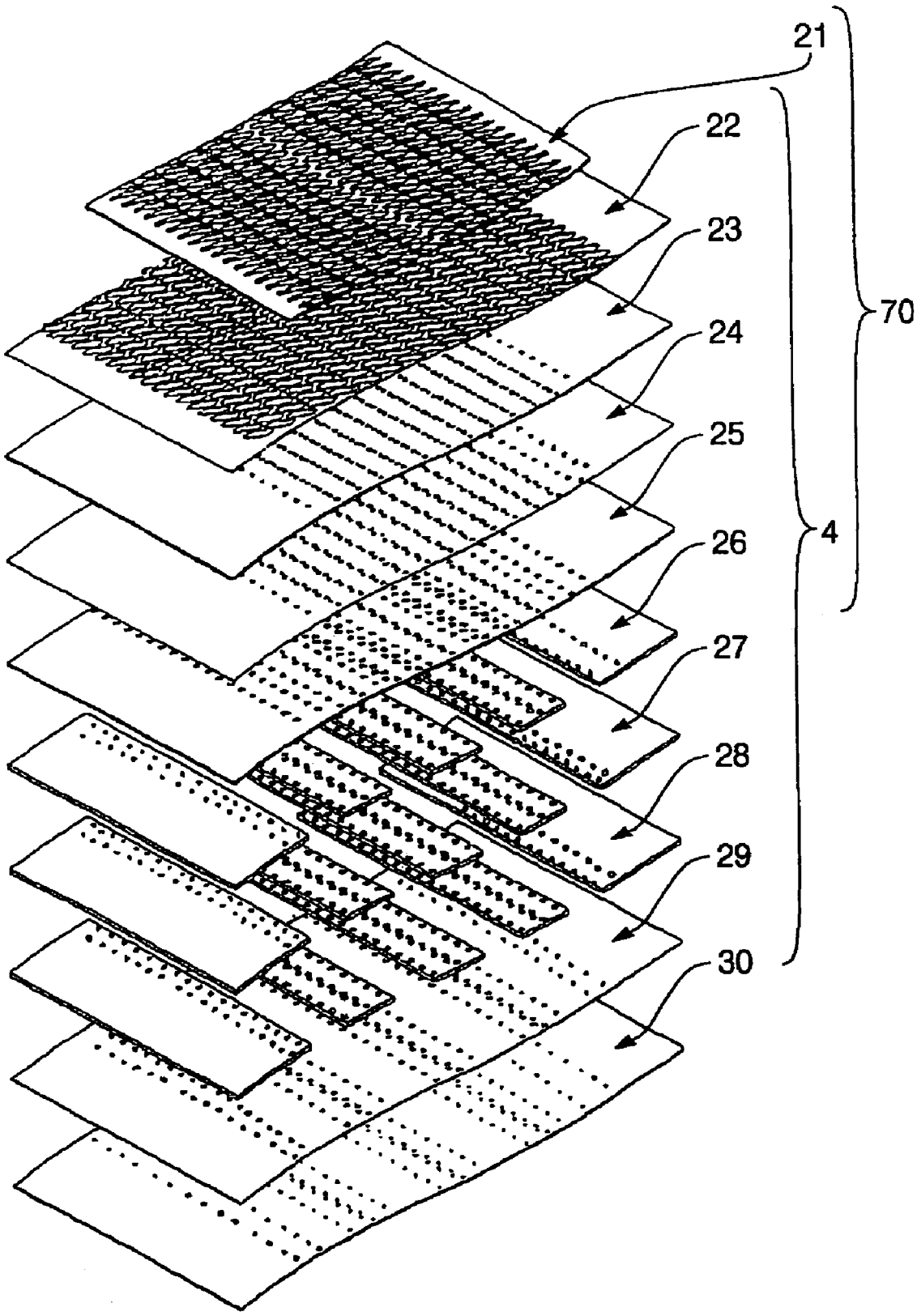
FIG. 8 is a sectional exploded view of the head body.

FIG. 8 is a sectional exploded view of the head body 70. As shown in FIG. 7, the nozzle 8 communicates with the sub-manifold 5*a* through the pressure chamber 10 (10*a*) and the aperture 12. From an outlet of the sub-manifold 5*a* to the nozzle 8, the ink flow channel 32 is formed. The ink flow channel 32 is provided for each of the pressure chambers 10 in the ink flow channel unit 4.

As show in FIG. 8, the head body 70 has the laminated structure composed of ten thin plates having, from the upper side, the actuator unit 21, a cavity plate 22, a base plate 23, an aperture plate 24, a supply plate 25, manifold plates 26, 27 and 28, a cover plate 29, and a nozzle plate 10. The nine plates 22-30 are metal thin plates which are adhered to one another by, for example, diffusion bonding.

Figure 9A:
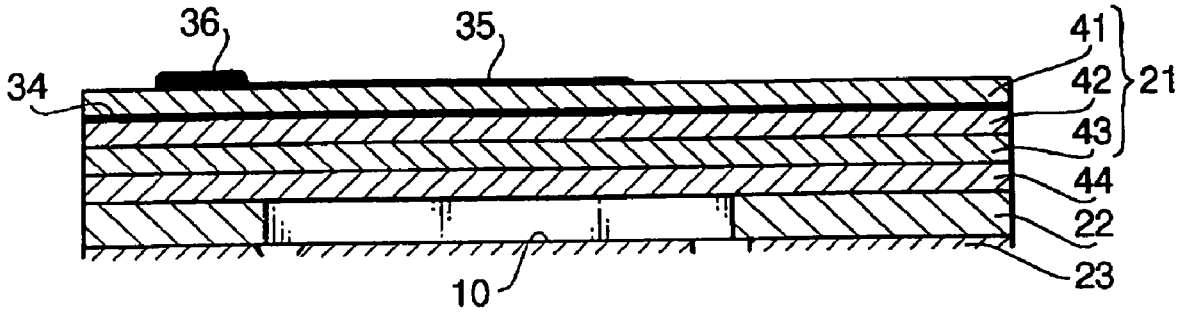
FIG. 9A is a cross sectional view of the actuator unit.

The actuator unit 21 includes four piezoelectric sheets 41-44 (see FIG. 9A). The cavity plate 22 has rhombic openings constituting the pressure chambers 10, respectively. The base plate 23 has two openings. One the openings of the base plate 23 connects the aperture 12 with the pressure chamber 10. The other opening of the base plate 23 connects the pressure chamber 10 with the nozzle 8.

The aperture plate 24 includes the aperture 12 configured to have two openings connected by a half etching region. The aperture unit 24 further has an opening which connects the pressure chamber 10 to the nozzle 8. The supply plate 25 has two openings. One of the openings of the supply late 25 connects the sub-manifold 5*a* with the aperture 12. The other opening of the supply plate 25 connects the pressure chamber 10 with the nozzle 8.

Each of the manifold plates 26-28 has an opening which constitutes the sub-manifold 5*a* when the manifold plates 26-28 are laminated. Each of the manifold plates 26-28 further has an opening which connects the pressure chamber 10 with the nozzle 8. The cover plate 29 has an opening which connects the pressure chamber 10 with the nozzle 8. The nozzle plate 30 has the nozzle 8. The nozzle 8 tapers down toward the lower side (i.e., the bottom surface) of the head body 70.

The nine plates 21-30 are registered with respect to each other and thereafter they are laminated, so that the ink flow channel 32 is formed. As shown in FIG. 7, the ink flow channel 32 extends toward the upper side from the outlet of the sub-manifold 5*a*, extends in the horizontal direction in the aperture 12, and further extends upward toward the pressure chamber 10. The ink flow channel 32 extends horizontally in the pressure chamber 10, extends obliquely toward the lower side, and then extends toward the nozzle 8 in the vertical direction.

Figure 9B:
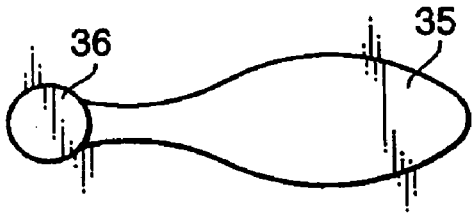
FIG. 9B is a plan view of one of electrodes provided on the actuator unit.

Next, the structure of the actuator unit 21 will be described in detail. FIG. 9A is a cross sectional view of the actuator unit 21. FIG. 9B is a plan view of one of the electrodes 35. As shown in FIG. 9A, the actuator unit 21 has the laminated structure including four piezoelectric sheets 41, 42, 43 and 44, each of which has a thickness of about 15 micrometer. In FIG. 9A, only a portion of the actuator unit 21 including one electrode 35 is indicated. In actuality, each piezoelectric sheet is provided on the entire actuator unit 21.

On the upper side surface of the actuator unit 21, a plurality of electrodes 35 are closely arranged. Such closely located electrodes 35 can be formed on the actuator unit 21 by, for example, the screen process printing. As described above, since the electrodes 35 and the pressure chambers 10 can be laid closely, printing resolution can be enhanced.

Each piezoelectric sheet is made of, for example, lead zirconate titanate (PZT) ceramic material that displays ferroelectricity. On the uppermost piezoelectric sheet 41, the electrode 35 is formed. Between the piezoelectric sheets 41 and 42, a common electrode 34 having a thickness of about 2 micrometer is located. The common electrode 34 expands over the entire region of the actuator unit 21. The electrode 35 and the common electrode 34 are made of, for example, Ag—Pd metal.

The electrode 35 has a thickness of about 1 micrometer. As shown in FIG. 9B, the electrode 35 includes a primary electrode region having a substantially rhombic form when it is viewed as a plan view, and a secondary electrode region that extends from one acute angle corner of the primary electrode portion. At a tip portion of the secondary electrode region, a circular land 36 having a diameter of about 160 micrometer is formed.

The circular land 36 is made of, for example, gold material including glass frit, and is fixed at the tip portion of the secondary electrode region. The land 36 is electrically connected to an electrode formed on the FPC 50.

The common electrode 34 is grounded. On the FPC 50, a plurality of electrodes and a plurality of lines are formed to respectively connect the electrodes 35 to the driver IC 80 in order to control potentials of the electrodes 35 individually.

Next, driving operation for the actuator unit 21 will be described in detail. The piezoelectric sheet 41 has been polarized in a direction of its thickness. With the above mentioned laminated structure of the actuator unit 21, the piezoelectric sheet 41 is used as an active layer (i.e., a layer including active layer portions), and the other piezoelectric sheets 42-44 are used as non-active layers. Such a structure of the actuator unit 21 is frequently called a unimorph type.

When a certain (minus or plus) potential is applied to the electrode 35, a portion of the piezoelectric sheet 41 can function as the active layer. More specifically, if a direction of an electric filed applied to a portion of the sheet 41 and the direction of polarization of the sheet 41 are substantially equal to each other, the portion of sheet 41 functions as the active layer, and the portion of the sheet 41 contracts by the piezoelectric effect in a direction perpendicular to the direction of the polarization. Hereafter, such a potential, that make the direction of the electric field and the direction of the polarization of the portion of the sheet 41 equal to each other, is referred to as an equivalent potential.

Meanwhile, the piezoelectric sheets 42-43 are not supplied with the electric field even if the electric field is applied to the portion of the sheet 41. Therefore, the sheets 42-43 do not contract when the portion of the sheet 41 contracts, which introduces a difference of distortion (in the direction of the polarization) between the sheet 41 and the sheets 42-44. As a result, the portions of the sheets 41-44 located below the electrode 35 are distorted such that they protrudes toward the pressure chamber 10. Such a phenomenon is frequently called a unimorph deformation.

When such a deformation of the sheets 41-44 occurs, the volumetric capacity of the pressure chamber 10 decreases, and thereby the pressure in the pressure chamber 10 increases.

A potential, that make the direction of the electric field and the direction of the polarization of the portion of the sheet 41 opposite to each other, is referred to as an inverse potential. When the inverse potential is applied to the electrode 35, the portions of the sheet 41-43 below the electrode 35 are distorted such that they protrudes toward the upper side (i.e., an electrode 35 side). When such an inverse deformation of the sheets 41-44 occurs, the volumetric capacity of the pressure chamber 10 increases, and thereby the pressure in the pressure chamber 10 is decreased.

The actuator unit 21 is driven by using a basic driving pattern in which initially the equivalent potential is applied to the electrode 35, secondly the inverse potential is applied to the electrode 35, and then the equivalent potential is applied to the electrode 35. With this basic driving pattern, firstly the ink is sucked from the sub-manifold 5*a* into the pressure chamber 10 when the potential of the electrode 35 changes from the equivalent potential to the inverse potential. Next, the ink is ejected from the nozzle 8 when the potential of the electrode 35 changes form the inverse potential to the equivalent potential. The basic driving pattern is accomplished by transmitting a rectangular pulse to the electrode 35 from the driver IC 80.

More specifically, a width of the pulse is set at a certain acoustic length (hereafter, referred to as an interval AL) corresponding to a time required for a pressure wave to propagate from the manifold 5 to the nozzle 8. Since the potential of the electrode 35 is changed form the inverse potential to the equivalent potential when the pressure in the pressure chamber 10 starts to change from negative pressure to positive pressure, two actions to bring a condition of the pressure chamber 10 to the positive pressure are combined. As a result, the ink can be ejected from the nozzle 8 with a high pressure.

In order to eject the ink from the nozzle 8, a potential difference between the equivalent potential and the inverse potential is required to be equal to or more than a certain value. In this embodiment, the equivalent potential is set at 20 volts and the inverse potential is set at −5 volts so as to eject the ink. Hereafter, the voltage of −5V as the inverse potential required to eject the ink is referred to as an inverse potential for ejection.

On the other hand, when it is required not to eject the ink, the inverse potential is set at 0V. Hereafter, the voltage of 0V as the inverse potential is referred to as an inverse potential for non-ejection. The voltages of 20V of the equivalent potential, and −5V and 0V of the inverse potential are indicated by way of example. Therefore, another voltage values may be used as the equivalent voltage and the inverse voltage.

The gray scale is represented by an amount of ink ejected onto the same position of the sheet. In this embodiment, the amount of the ink (i.e., density of a dot) is adjusted by controlling the number of drops of the ink successively ejected onto the same position of the sheet. To successively eject two or more drops of ink form the nozzle 8, two or more pulses are successively inputted to the electrode 35.

An interval of the successive pulses is set equal to the interval AL. Therefore, a cycle of a residual pressure wave of a pressure wave applied by one pulse of the successive pulses becomes equal to a cycle of a pressure wave applied by a succeeding pulse. Further, in this case, a peak of the residual pressure wave caused by the one pulse and a peak of the pressure wave caused by the succeeding pulse become equal to each other, by which the pressure of the pressure wave caused by the succeeding pulse is amplified.

Consequently, a speed of a drop of ink ejected by the succeeding pulse (i.e., the succeeding drop of ink) becomes higher than a speed of a drop of ink ejected by a preceding pulse (i.e., the preceding drop of ink). Accordingly, the succeeding drop of ink catches up with the preceding drop of ink, and therefore the two drops ink are united with each other.

It is noted that such a controlling scheme using the successive pulses having the interval AL enables to eject a desired amount of ink with a relatively low potential difference by use of an amplification effect of the pressure wave and the resident pressure wave.

Figure 10:
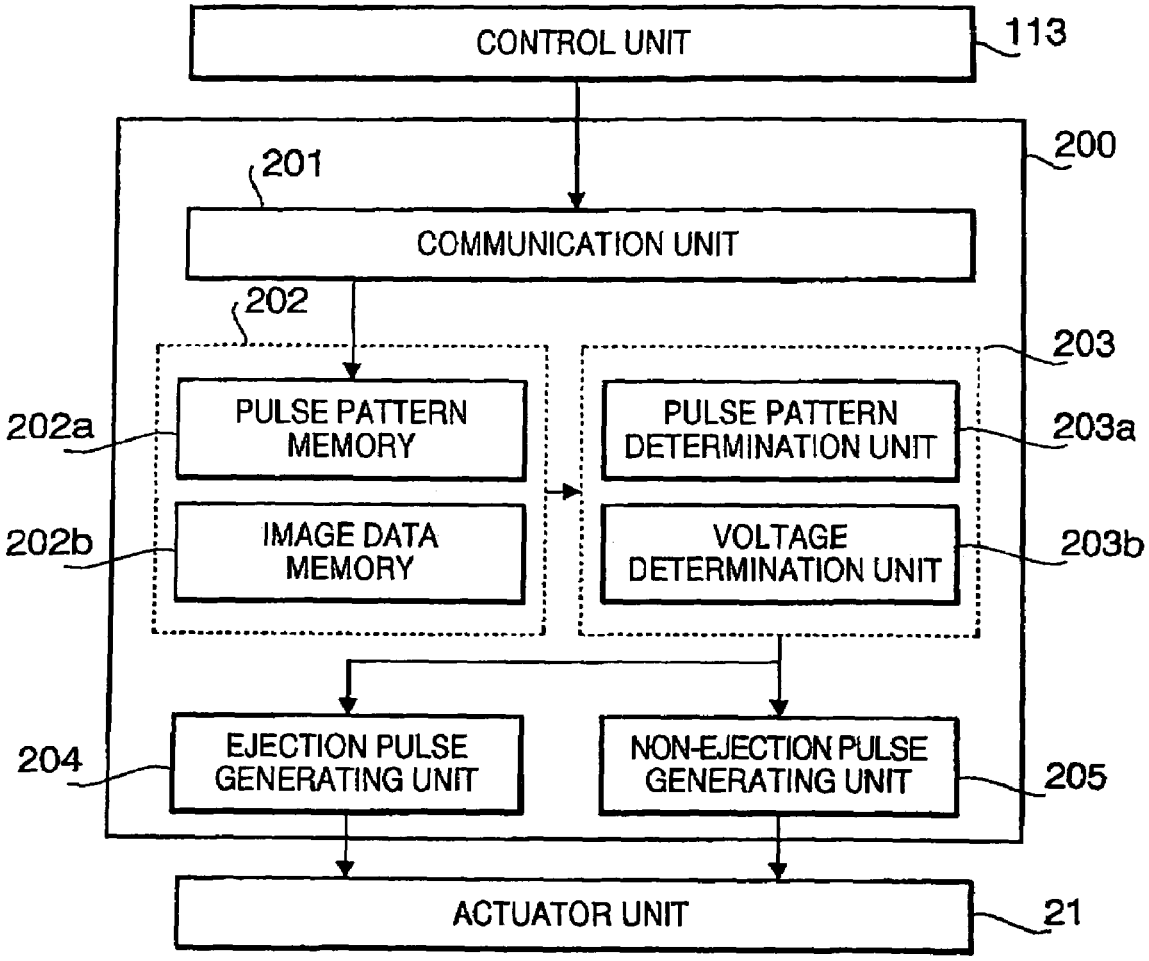
FIG. 10 shows a functional block diagram of a pulse generator according to the first embodiment.

Next, the function of the pulse generator 200 will be described in detail. FIG. 10 shows a functional block diagram of the pulse generator 200. On the printed circuit board 81, a CPU (central processing unit), a ROM (read only memory) that stores various programs to be executed by the CPU, and a RAM (random access memory) that is used to store temporarily data for the execution of the program are mounted. The functional blocks shown in FIG. 10 is accomplished by the functions of the CPU, ROM and RAM mounted on the printed circuit board 81 and circuits provided in the driver IC 80.

As shown in FIG. 10, the pulse generator 200 includes a communication unit 201, a memory 202, a determination unit 203, an ejection pulse generating unit 204, and a non-ejection pulse generating unit 205.

The communication unit 201 communicates with the control unit 113. Te pulse generator 200 receives, from the control unit 113, image data having color components of magenta, yellow, cyan and black, each of which has a gray scale. The pulse generator 200 further receives, from the control unit 113, timing data having timing information regarding the ejection of the ink for each pixel of the image data.

The communication unit 201 receives the image data and the timing data from the control unit 113 and stores them into the memory 202. The memory 202 is constituted of the ROM and RAM mounted on the printed circuit board 81. The memory 201 has a pulse pattern memory 202*a* and an image data memory 202*b*. The pulse pattern memory 202*a* is constituted of the ROM, and stores various types of pulse patterns respectively corresponding to gray scale levels.

Figure 11A:
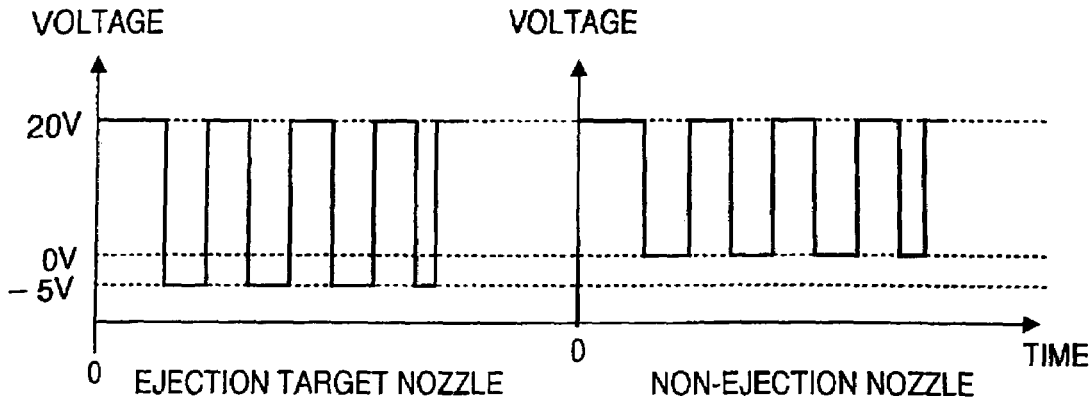
FIG. 11A shows a pulse pattern for ejecting successive three drops of ink for forming the densest dot.
Figure 11B:
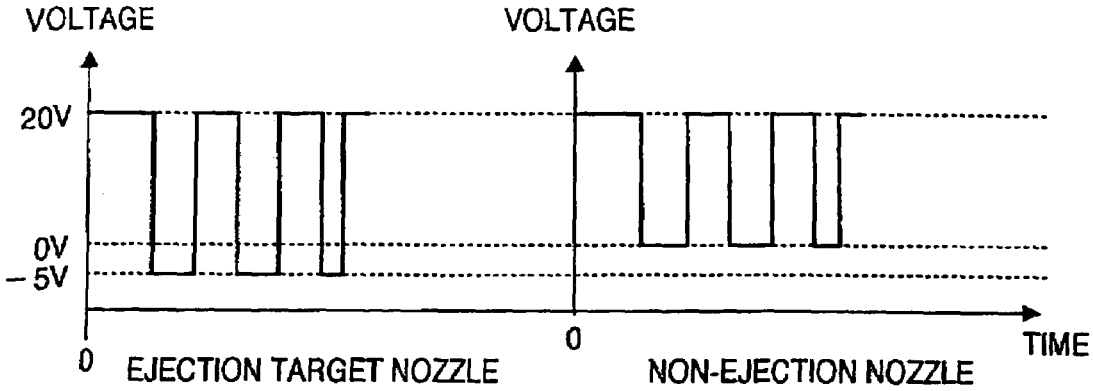
FIG. 11B shows a pulse pattern for ejecting successive two drops of ink for forming the second densest dot.
Figure 11C:
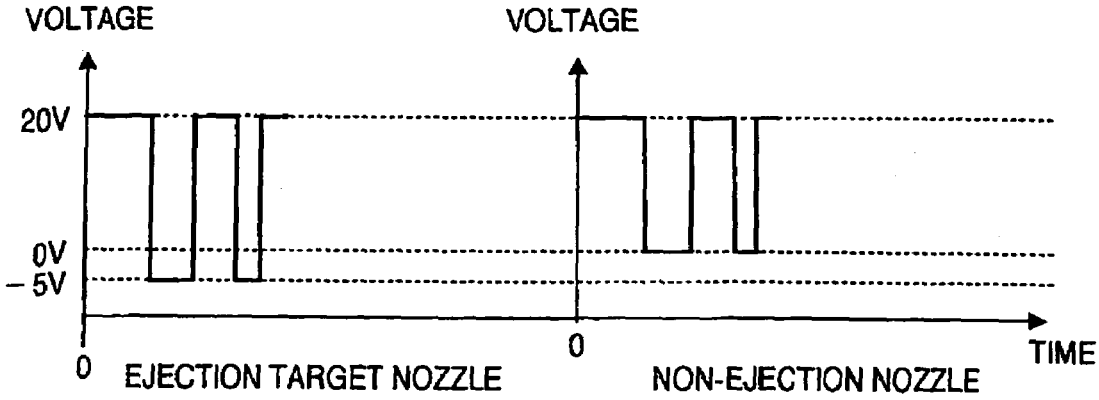
FIG. 11C shows a pulse pattern for ejecting a drop of ink for forming the third densest dot.

FIGS. 11A, 11B and 11C show timing charts of pulses generated by the pulse generator 200. In the inkjet head 1 according to the embodiment, pulses having the inverse potential for ejection (−5V) are applied to the electrode 35 for the nozzle 8 targeted for the ejection of the ink (hereafter, referred to as an ejection target nozzle 8). On the other hand, pulses having the inverse potential for non-ejection (0V) is applied to one or more electrodes 35 for one or more nozzles 8 adjacent to the ejection target nozzle 8 (hereafter referred to as a non-ejection nozzles 8).

In each of FIGS. 11A, 11B and 11C, a left half part indicates a timing chart of one of pulse patterns for the ejection target nozzle 8, and a right half part indicates a timing chart of one of pulse patterns for the non-ejection nozzles 8. FIG. 11A shows a pulse pattern for ejecting successive three drops of ink (i.e., a pulse pattern for forming the densest dot on the sheet). FIG. 11B shows a pulse pattern for ejecting successive two drops of ink (i.e., a pulse pattern for forming the second densest dot on the sheet). FIG. 11C shows a pulse pattern for ejecting a drop of ink (i.e., a pulse pattern for forming the third densest dot on the sheet).

The pulse patterns shown in FIGS. 11A-11C include one or more negative pulses. The number of pulses included in the pulse pattern is determined in accordance with the number of drops of ink to be successively ejected from the nozzle 8. The number of drops of ink to be successively ejected from the nozzle 8 is determined depending on the amount of ink selected based on gray scale information in the image data. In this embodiment, the amount of ink is changed in three levels based on the gray scale information.

Additionally or alternatively, the cycle and phase of the pulses included in the pulse pattern may be determined depending on the amount of ink selected based on gray scale information.

In the pulse pattern, one or more (1-3) negative pulses each having a pulse width of the interval AL are included. Further, a negative pulse having a pulse width of half of the interval AL is added to a last part of the pulse pattern. The last pulse having the pulse width of half of the interval AL generates a pressure wave (hereafter, referred to as a cancel wave) for canceling pressure remaining in the pressure chamber 10.

Data representing the three types of the pulse patterns indicated in FIGS. 11A-11C is stored in the pulse pattern memory 202*a*. The image data memory 202*b* is constituted of the RAM, and stores the image data and the timing data sent from the control unit 113.

The determination unit 203 determines the type of the pulse pattern and the voltage of the pluses of the pulse pattern. The determination unit 203 includes a pulse pattern determination unit 203*a* and a voltage determination unit 203*b*. The pulse pattern determination unit 203*a* determines the type of the pulse pattern to be applied to the electrode 35 based on the timing data and the gray scale information in the image data.

More specifically, the pulse pattern determination unit 203*a* selects one pulse pattern from the pulse patterns stored in the pulse pattern memory 202*a* based on gray scale information of the image data. Further, the determination unit 203 determines one or more nozzles 8 corresponding to each pixel in the image data based on the timing data stored in the memory 202.

In the determination unit 203, the pulse pattern applied to the electrode 35 for the ejection target nozzle 8 is determined based on the gray scale information of a pixel corresponding to the ejection target nozzle 8. If, one or more ejection target nozzles exist adjacently to a non-ejection nozzle, the pulse pattern for the non-ejection nozzle is determined according to the densest gray level of gray levels of the one or more neighboring ejection target nozzles. If no ejection target nozzle exists adjacently to the non-ejection nozzle, no pulse pattern is determined for the non-ejection nozzle.

The voltage determination unit 203*b* determines a voltage value of the inverse potential based on the image data stored in the image data memory 202*b*. That is, the voltage value of the inverse potential for the ejection target nozzle is set at −5V and the voltage value of the inverse potential for the non-ejection nozzle is set at 0V.

The ejection pulse generating unit 204 generates pulses according to the pulse pattern selected by the pulse pattern determination unit 203*a* and the voltage value of −5V determined by the voltage determination unit 203*b*. The pulses generated by the ejection pulse generating unit 204 are transmitted to the electrode 35 corresponding to the ejection target nozzle 8.

The non-ejection pulse generating unit 205 generates pulses according to the pulse pattern selected by the pulse pattern determination unit 203*a* and the voltage value of 0V determined by the voltage determination unit 203*b*. The pulses generated by the non-ejection pulse generating unit 205 are transmitted to the electrode 35 corresponding to the non-ejection nozzle 8.

Figure 12:
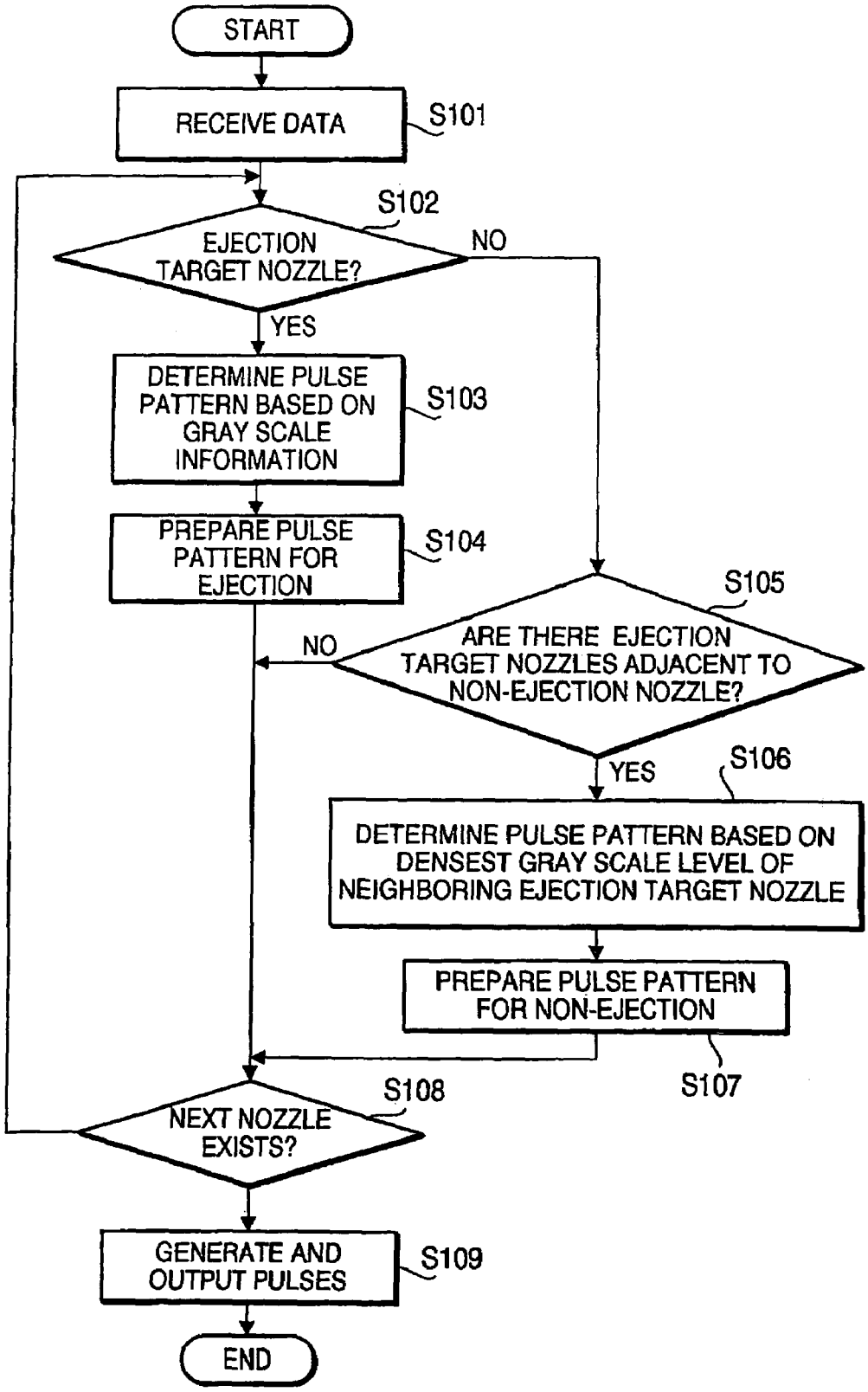
FIG. 12 is a flowchart showing a pulse generation process executed by the pulse generator according to the first embodiment.

Next, operation of the pulse generator 200 will be described in detail. FIG. 12 is a flowchart showing a pulse generation process executed by the pulse generator 200. When the power of the inkjet printer 101 is turned to ON, the pulse generator waits until the image data and the timing data are transmitted from the control unit 113. When the communication unit 201 receives the image data, and the timing data, the communication unit 201 stores the image data and the timing data into the image data memory 202*b* (step S101).

In a sequence of steps S102 trough S108, the nozzles 8 are processed one by one to generate the pulse pattern. In step S102, the pulse generator 200 determines whether one nozzle 8 to be processed is the ejection target nozzle or the non-ejection nozzle using the image data and the timing data stored the image data memory 202*b*.

When the nozzle 8 is the non-ejection nozzle (S102: NO), control proceeds to step S105. When the nozzle 8 is the ejection target nozzle (S102: YES), control proceeds to step S103 where the pulse pattern determination unit 203*a* selects the pulse pattern to be applied to the electrode 35 for the ejection target nozzle based on the gray scale information in the image data. Further, in step S103, the voltage value of the inverse potential is set at −5V by the voltage determination unit 203*b*.

Next, in step S104, data of the pulse pattern determined in step S103 is stored in a register in the ejection pulse generating unit 204 to finish the preparation of the pulse pattern. Then, control proceeds to step S108.

In step S105, it is determined whether one or more ejection target nozzles exist adjacently to the non-ejection nozzle. When it is determined that no ejection target nozzle exists adjacently to the non-ejection nozzle (S105: NO), control proceeds step S108. When it is determined that one or more ejection target nozzles exist adjacently to the non-ejection nozzle (S105: YES), control proceeds to step S106.

In step S106, the pulse pattern for the non-ejection nozzle is set to one corresponding to the densest gray scale level of the gray scale levels of the one or more neighboring ejection target nozzles adjacent to the non-ejection nozzle. Further, in step S106, the voltage value of the inverse potential is set at 0V. Next, in step S107, data of the pulse pattern determined in step S106 is stored in a register in the non-ejection pulse generating unit 205 to finish the preparation of the pulse pattern. Then, control proceeds to step S108.

In step S108, it is determined whether a next nozzle 8 (i.e., at least one remaining nozzle 8), which is not processed, exists or not. When the next nozzle 8 exists (S108: YES), control returns to step S102. When all of the nozzles are processed (S108: NO), control proceeds to step S109.

In step S109, the ejection pulse generating unit 204 and the non-ejection pulse generating unit 205 generate and output the pulses according to the data stored in their respective registers. The pulse patterns generated by the ejection pulse generating unit 204 or the non-ejection pulse generating unit 205 are transmitted to the electrodes 35, respectively. Then, the pulse generation process terminates.

According to the pulse generation process shown in FIG. 12, the electrode 35 for the non-ejection nozzle, which is adjacent to the ejection target nozzle, is supplied with the pulse pattern in synchronization with the pulse pattern for the neighboring ejection target nozzle 8. Further, the electrode 35 for the non-ejection nozzle, which is not adjacent to the ejection target nozzle, is not supplied with the pulse pattern. With this driving scheme, the portion of the piezoelectric sheet corresponding to the ejection target nozzle is subjected to the structural crosstalk from neighboring potions of the piezoelectric, sheet corresponding to the neighboring nozzles, regardless of whether the neighboring nozzles are the ejection target nozzle or the non-ejection nozzle.

Therefore, the effects of the structural crosstalk on the ejection target nozzles can be uniformed over the entire region of each actuator unit 21, and thereby it becomes possible to represent gray scale while preventing the deterioration of the image by the structural crosstalk. Further, power savings are achieved.

Pulse pattern determination can be executed very quickly because the determination unit 203 can use the memory 202 in which all of the pulse patterns are stored.

According to the pulse generation process shown in FIG. 12, the pulse pattern of the non-ejection nozzle is set to the pulse pattern of one of the neighboring ejection target nozzles having the densest gray level. Therefore, the effects of the structural crosstalk, caused by the non-ejection nozzles, on the ejection target nozzle can be uniformed, regardless of the number of drops of ink of the neighboring ejection target nozzles.

If the gray scale levels of the neighboring ejection target nozzles adjacent to the non-ejection nozzle are all relatively low, the pulse pattern of the non-ejection nozzle is also set to one having the relatively small number of pulses. Therefore, it becomes possible to avoid needless operation of the non-ejection nozzle which is not required to contribute to the uniformalization of the effects of the structural crosstalk. Consequently, power savings can be attained.

Second Embodiment

Hereafter, an inkjet printer according to a second embodiment of the invention will be described. The feature of the inkjet printer according to the second embodiment is that only the function of a pulse generator 200A is different from that of the pulse generator 200 of the first embodiment. Therefore, to elements which are similar to those of the first embodiment, same reference numbers are assigned, and explanations thereof will not be repeated.

Figure 13:
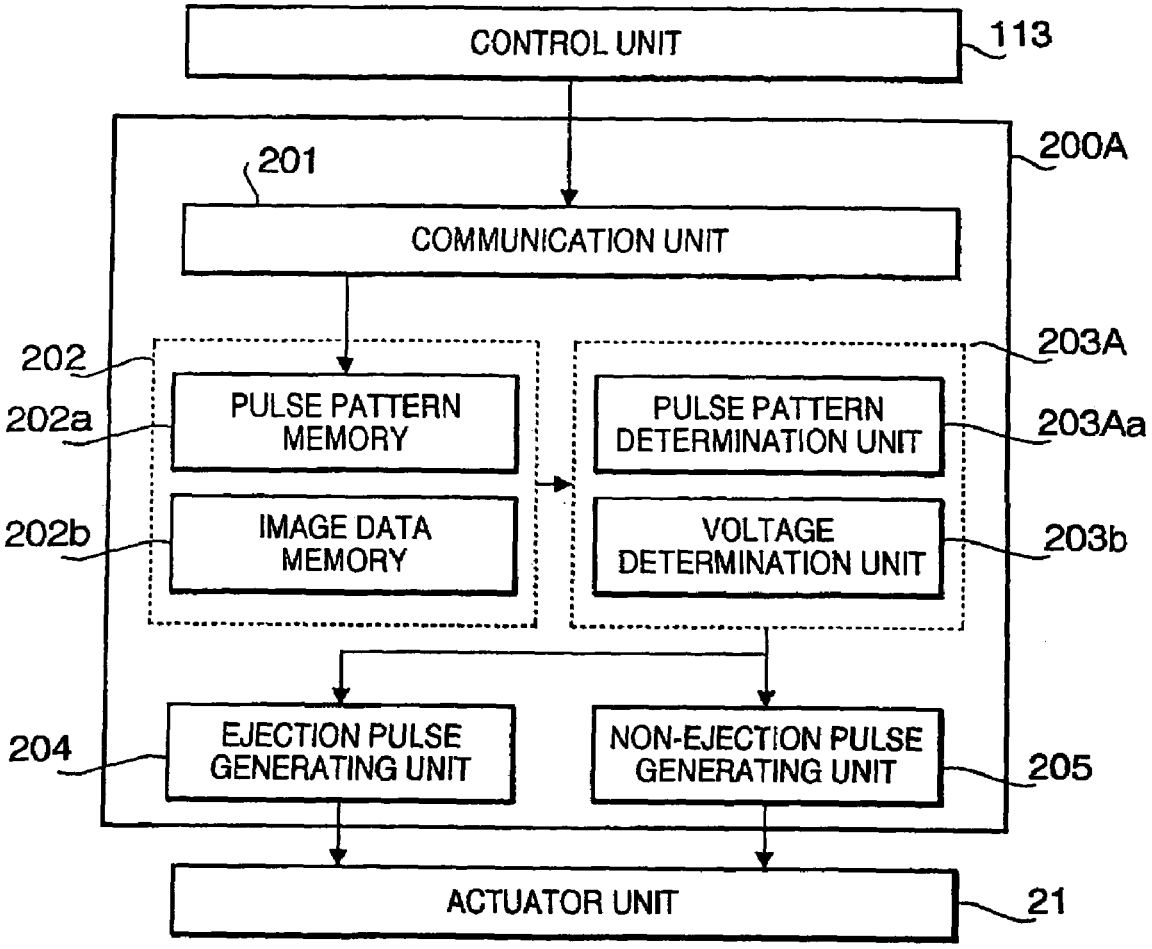
FIG. 13 shows a block diagram of a pulse generator according to a second embodiment.

FIG. 13 shows a block diagram of the pulse generator 200A which is constituted of the CPU, ROM storing the programs and RAM mounted on the printed circuit board 81, and the driver IC 80. As shown in FIG. 13, the same functional units, i.e., the communication unit 201, the memory 202, the ejection pulse generating unit 204, and the non-ejection pulse generating unit 205, which are used in the pulse generator 200 of the first embodiment, are also used in the pulse generator 200A. Therefore, the explanation of the pulse generator 200A will be made with regard to a determination unit 203A.

The determination unit 203A determines the type of the pulse pattern and the voltage of the pluses of the pulse pattern. The determination unit 203A includes a pulse pattern determination unit 203Aa and the voltage determination unit 203*b*. The pulse pattern determination unit 203Aa determines the type of the pulse pattern to be applied to the electrode 35 based on the timing data and the gray scale information in the image data.

More specifically, the pulse pattern determination unit 203Aa selects one pulse pattern from the pulse patterns stored in the pulse pattern memory 202*a* based on gray scale information of the image data. Further, the determination unit 203 determines one or more nozzles 8 corresponding to each pixel in the image data based on the timing data stored in the memory 202.

In the determination unit 203, the pulse pattern applied to the electrode 35 for the ejection target nozzle 8 is determined based on the gray scale information of a pixel corresponding to the ejection target nozzle 8. If one or more ejection target nozzles exist adjacently to a non-ejection nozzle, the pulse pattern for the non-ejection nozzle is determined according to the densest gray level of gray levels of the one or more neighboring ejection target nozzles. If no ejection target nozzle exists adjacently to the non-ejection nozzle, no pulse pattern is determined for the non-ejection nozzle.

The voltage determination unit 203*b* determines a voltage value of the inverse potential based on the image data stored in the image data memory 202*b*. That is, the voltage value for the ejection target nozzle is set to be −5V and the voltage value for the non-ejection nozzle is set to be 0V.

Figure 14:
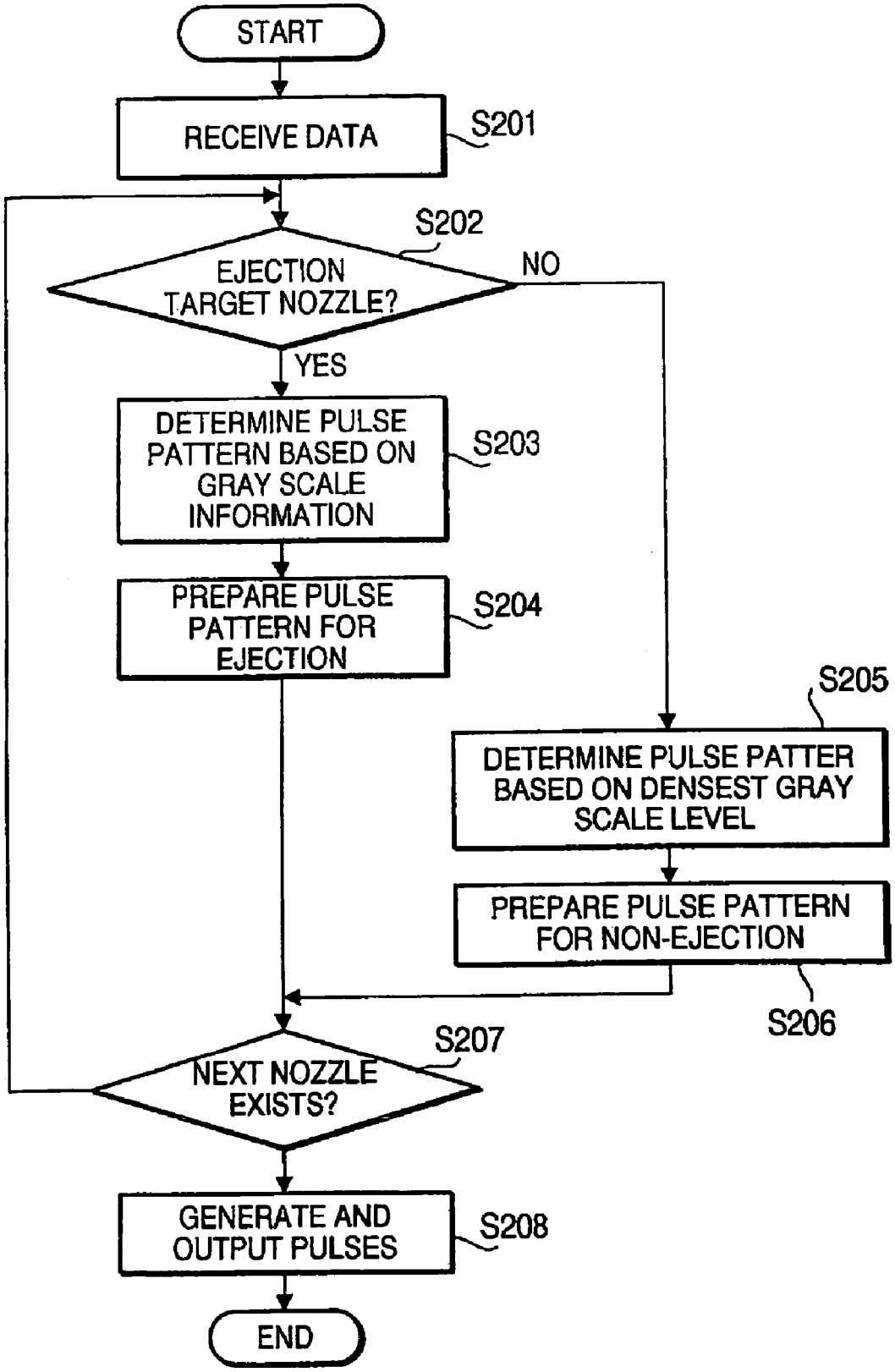
FIG. 14 is a flowchart showing a pulse generation process executed by the pulse generator shown in FIG. 13.

Next, operation of the pulse generator 203A will be described in detail. FIG. 14 is a flowchart showing a pulse generation process executed by the pulse generator 200A. When the power of the inkjet printer 101 is turned to ON, the pulse generator 200A waits until the image data and the timing data are transmitted from the control unit 113. When the communication unit 201 receives the image data and the timing data, the communication unit 201 stores the image data and the timing data into the image data memory 202*b* (step S201).

In a sequence of steps S202 trough S207, the nozzles 8 are processed one by one to generate the pulse pattern. In step S202, the pulse generator 200A determines whether one nozzle 8 to be processed is the ejection target nozzle or the non-ejection nozzle using the image data and the timing data stored the image data memory 202*b*.

When the nozzle 8 is the non-ejection nozzle (S202: NO), control proceeds to step S105. When the nozzle 8 is the ejection target nozzle (S202: YES), control proceeds to step S203 where the pulse pattern determination unit 203Aa selects the pulse pattern to be applied to the electrode 35 for the ejection target nozzle based on the gray scale information in the image data. Further, in step S203, the voltage value of the inverse potential is set to −5V by the voltage determination unit 203*b*.

Next, in step S204, data of the pulse pattern determined in step S203 is stored in a register in the ejection pulse generating unit 204 to finish the preparation of the pulse pattern. Then, control proceeds to step S207.

In step S205, the pulse pattern for the non-ejection nozzle is set to one corresponding to the densest gray scale level of the gray scale levels stored in the pulse pattern memory 202*a*. Further, in step S205, the voltage value of the inverse potential is set to 0V. Next, in step S206, data of the pulse pattern determined in step S205 is stored in a register in the non-ejection pulse generating unit 205 to finish the preparation of the pulse pattern. Then, control proceeds to step S207.

In step S207, it is determined whether a next nozzle 8 (i.e., at least one remaining nozzle 8), which is not processed, exists or not. When the next nozzle 8 exists (S208: YES), control returns to step S202. When all of the nozzles are processed (S208: NO), control proceeds to step S208.

In step S208, the ejection pulse generating unit 204 and the non-ejection pulse generating unit 205 generate and outputs the pulses according to the data stored In their respective registers. The pulse patterns generated by the ejection pulse generating unit 204 or the non-ejection pulse generating unit 205 are transmitted to the electrodes 35, respectively. Then, the pulse generation process terminates.

According to the pulse generation process shown in FIG. 14, to each electrode 35 for the non-ejection nozzle 8, the pulse pattern corresponding to the densest gray scale level of the gray scale levels stored in the pulse pattern memory 202*a* is applied. Therefore, all of portions of the piezoelectric sheet 41 respectively corresponding to the ejection target nozzles are subjected to the structural crosstalk from their neighboring nozzles regardless of whether the neighboring nozzles are the non-ejection nozzles or the ejection target nozzles.

As a result, effects of the structural crosstalk on the ejection target nozzles can be uniformed over the entire region of each actuator unit 21, and thereby it becomes possible to represent gray scale while preventing the deterioration of the image caused by the structural crosstalk.

Further, according to the pulse generation process shown in FIG. 14, all of the non-ejection nozzles are driven constantly by the pulse pattern for the non-ejection nozzle. Therefore, it is prevented that the viscosity of the ink in the nozzles. (i.e., the non-ejection nozzle) increases and thereby the ejection performance is deteriorated due to the residence of the ink in the nozzle.

Further, according to the pulse generation process shown in FIG. 14, the process executed by the pulse generator 203A becomes easier and faster than the case of the pulse generator 200 of the first embodiment.

Third Embodiment

Hereafter, an inkjet printer according to a third embodiment of the invention will be described. The feature of the inkjet printer according to the third embodiment is that only the function of a pulse generator 200B is different from that of the pulse generator 200 of the first embodiment. Therefore, to elements which are similar to those of the first embodiment, same reference numbers are assigned, and explanations thereof will not be repeated.

Figure 15:
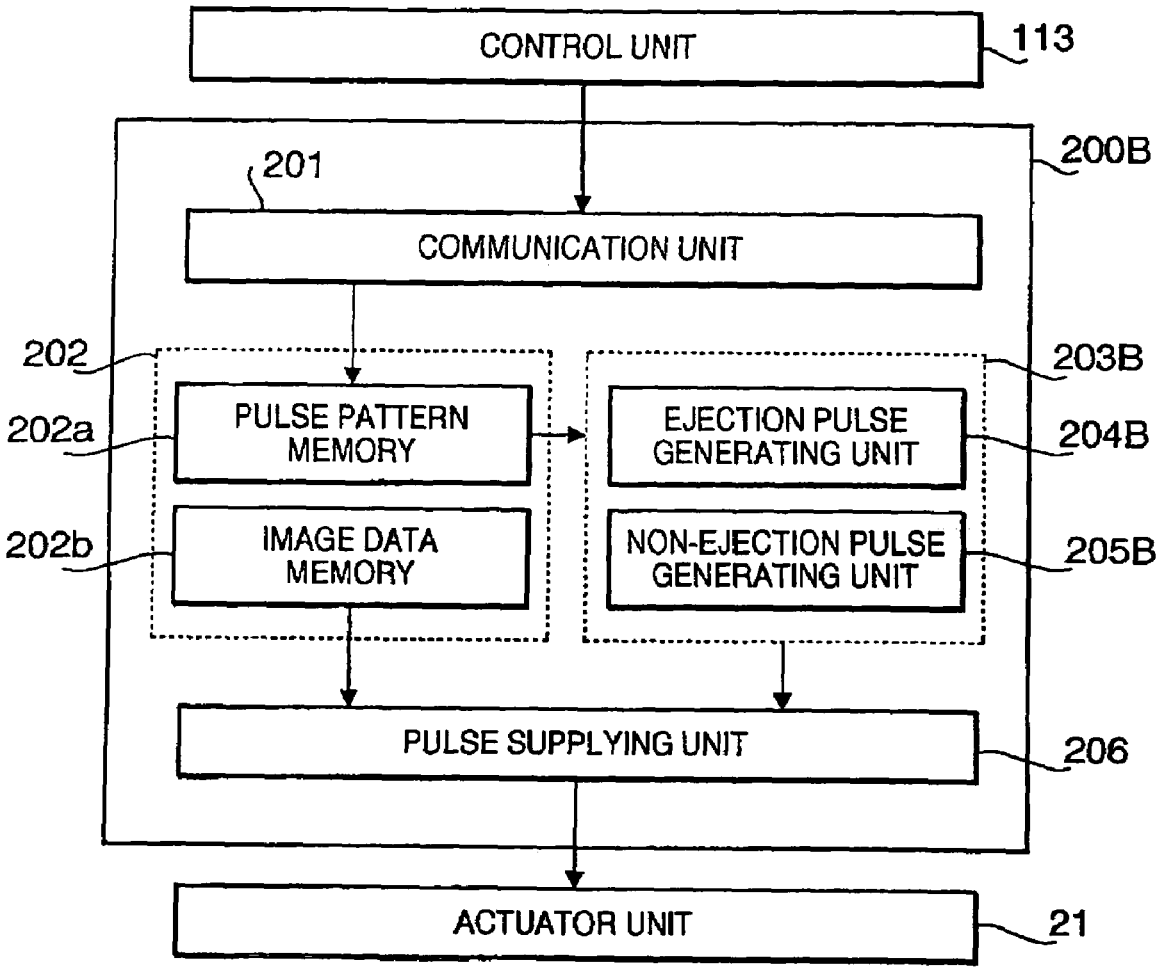
FIG. 15 shows a block diagram of a pulse generator according to a third embodiment.

FIG. 15 shows a block diagram of the pulse generator 200B which is constituted of the CPU, ROM storing the programs and RAM mounted on the printed circuit board 81, and the driver IC 80. As shown in FIG. 15, the pulse generator 200B includes the communication unit 201, the memory 202, an ejection pulse generating unit 204B and a non-ejection pulse generating unit 205B, and a pulse supplying unit 206. Since the communication unit 201 and the memory 202 are the same as those of the first embodiment, the explanation thereof will not be repeated.

The ejection pulse generating unit 204B generates pulses of the pulse pattern to be applied to the ejection target nozzle based on the pulse patterns (which are indicated in FIGS.

11A-11C) stored in the pulse pattern memory 202*a*, and the image data and the gray scale information stored in the image data memory 202*b*. Further, the ejection pulse generating unit 204B set the equivalent potential at 20V and the inverse potential at −5V. Output timing of the pulses of the pulse pattern for the ejection target nozzle generated by the ejection pulse generating unit 204B is determined in the pulse supplying unit 206.

The non-ejection pulse generating unit 205B generates pulses of the pulse pattern to be applied to the non-ejection nozzle. By the non-ejection pulse generating unit 205B, the pulse pattern for the non-ejection nozzle is determined to be one corresponding to the densest gray scale level of the gray scale levels stored in the pulse pattern memory 202*a*. Further, non-ejection pulse generating unit 205B set the equivalent potential at 20V and the inverse potential at 0V. Output timing of the pulses of the pulse pattern for the non-ejection nozzle generated by the non-ejection pulse generating unit 205B is determined in the pulse supplying unit 206.

The pulse supplying unit 206 supplies the electrodes 35 with the pulses generated by the ejection pulse generating unit 204B and the non-ejection pulse generating unit 205B. Further, the pulse supplying unit 206 determines one or more nozzles 8 corresponding to each pixel in the image data based on the timing data stored in the memory 202. The pulse supplying unit 206 determines whether the nozzle is the ejection target nozzle or the non-ejection nozzle one by one for all of the nozzles based on the data stored in the memory 202.

Further, the pulse supplying unit 206 selects the type of the pulse pattern to be applied to the ejection target nozzle based on the gray scale information stored in the image data stored in the image data memory 202*b*.

According to the third embodiment, to each electrode 35 for the non-ejection nozzle 8, the pulse pattern corresponding to the densest gray scale level of the gray scale levels stored in the pulse pattern memory 202*a* is applied. Therefore, all of portions of the piezoelectric sheet 41 respectively corresponding to the ejection target nozzles are subjected to the structural crosstalk from their neighboring nozzles regardless of whether the neighboring nozzles are the non-ejection nozzles or the ejection target nozzles.

As a result, effects of the structural crosstalk on the ejection target nozzles can be uniformed over the entire region of each actuator unit 21, and thereby it becomes possible to represent gray scale while preventing the deterioration of the image caused by the structural crosstalk.

Further, according to the third embodiment, all of the non-ejection nozzles are driven constantly by the pulse pattern for the non-ejection nozzle. Therefore, it is prevented that the viscosity of the ink in the nozzles (i.e., the non-ejection nozzle) increases and thereby the ejection performance is deteriorated due to the residence of the ink in the nozzle.

Further, according to the third embodiment, the process executed by the pulse supplying unit 206 becomes easier and faster than the case of the pulse generator 200 of the first embodiment.

Although the present invention has been described in considerable detail with reference to certain preferred embodiments thereof, other embodiments are possible.

For example, although in the above mentioned embodiments the pulse pattern is determined from the pulse patterns stored in the pulse pattern memory 202*a*, the pulse pattern for the ejection target nozzle or the no-ejection nozzle may be determined by calculation based on the gray scale level information in the image data without using the pulse pattern memory 202*a*.

As described above, in the first embodiment, when one or more ejection target nozzles adjoin to a non-ejection nozzle, the pulse pattern for the non-ejection nozzle, is determined to be one corresponding to the densest gray scale level of gray scale levels of the one or more ejection target nozzles. However, when one or more ejection target nozzles adjoin to a non-ejection nozzle, the pulse pattern for the non-ejection nozzle may be determined to be one corresponding to the densest gray scale level of gray scale levels stored in the pulse pattern memory regardless of the gray scale levels of the one or more neighboring ejection target nozzles.

As described above, in the second embodiment the pulse pattern for each of the non-ejection nozzle is determined to be one corresponding to the densest gray scale level of the gray scale levels stored in the pulse pattern memory. However, the pulse pattern for each of the non-ejection nozzle may be determined to be one corresponding to a predetermined gray scale level. Alternatively, the pulse pattern for each of the non-ejection nozzle may be determined to be one corresponding to the densest gray scale level of gray scale levels of all pixels of the image data.

In the second embodiment, the electrodes 35 for all of the non-ejection nozzles are supplied with pulse patterns. However, only a portion of the electrodes for all of the non-ejection nozzles (for example, electrodes 35 corresponding to the non-ejection nozzle which is adjacent to the ejection target nozzle) may be supplied with the pulse pattern.

In the above mentioned embodiments, each of the pulse patterns stored in the pulse pattern memory 202*a* has the pulse for the cancel wave in its last part. However, each pulse pattern may be configured not to have the pulse for the cancel wave. For example, the pulse for the cancel wave may be generated and added to each pulse pattern by the he ejection pulse generating unit 204 or the non-ejection pulse generating unit 205.

In the above mentioned embodiments, each of the pressure chambers 10 and the electrodes 35 has the form of a parallelogram. Further, the pressure chambers 10 and the electrodes 35 are arranged in a matrix. However, the shapes and the arrangements of the pressure cambers 10 and the electrodes 35 are not limited to the shapes and arrangements described in the above mentioned embodiments.

In the first embodiment, the pulse pattern for a non-ejection nozzle is determined depending on all of the neighboring ejection target nozzles that adjoin to the non-ejection nozzle. However, the pulse pattern for the non-ejection nozzle may be determined depending on a portion of all of the neighboring ejection target nozzles which adjoin to the non-ejection nozzle. For example, the pulse pattern for the non-ejection nozzle may be determined depending on the neighboring ejection target nozzles which are positioned, with reference to the non-ejection nozzle, along a direction in which the effect of the structural crosstalk caused by the electrode for the non-ejection nozzle becomes maximum. Alternatively, the pulse pattern for the non-ejection nozzle may be determined depending on the neighboring ejection target nozzles which have a certain positional relationship with reference to the non-ejection nozzle.

In the above mentioned embodiment, each electrode 35 has the primary electrode region having a substantially rhombic form, and the secondary electrode region that extends from one acute angle corner of the primary electrode portion. Further, the plurality of electrodes 35 are arranged on the actuator unit 21 in a matrix such that each of the primary electrode region lies in a gap between two adjacent secondary electrode regions of the neighboring electrodes 35.

When at least one of the two neighboring electrodes corresponding to the two neighboring secondary electrode portions is the non-ejection electrode, the pulse pattern of the non-ejection electrode (corresponding to one of the two neighboring secondary electrode portions) may be determined to be one corresponding to the densest gray scale level of gray scale levels stored in the pulse pattern memory 202*a* regardless of whether the gray scale of the ejection target nozzle which lies in the gap.

Although in the above mentioned embodiments, the pulse generation process (e.g., the flowchart shown in FIG. 12) is performed with regard to each of the plurality of nozzle, the process may be performed with regard to each of the ink flow channels or each of the pressure chambers. For example, the determination step S102 may be performed to determined, for each of the pressure chambers (or the ink flow channels), whether the pressure chamber (or the ink flow channel) is to eject the ink or not, and thereafter the other steps may be performed with regard to the pressure chambers (or the ink flow channels). It is understood that such a pulse generation process regarding the pressure chambers (or the ink flow channels) can also attain the above mentioned advantage of the embodiments. In this case, the pulse pattern for the uniformalization of the effects of the structural crosstalk is applied to the electrode corresponding to the pressure chamber (or the ink flow channel) determined not to eject the ink regardless of the positions of the nozzles.

The present disclosure relates to the subject matter contained in Japanese Patent Application No. 2003-293544, filed on Aug. 14, 2003, which is expressly incorporated herein by reference in its entirety.

What is claimed is:

1. An inkjet head printing device, comprising:

an inkjet head that has an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles;

a pulse generator that determines whether each of the plurality of nozzles ejects the ink or not, and determines an amount of ink to be ejected from each of the plurality of nozzles based on gray scale information in image data to be formed, wherein the pulse generator determines first pulse patterns to be applied to electrodes respectively corresponding to nozzles determined to eject the ink by the pulse generator, the first pulse patterns respectively corresponding to amounts of ink of the nozzles determined to eject the ink by the pulse generator, each of the first pulse patterns having a first potential which causes each of the plurality of nozzles to eject the ink, and wherein the pulse generator determines a second pulse pattern to be applied to at least one of electrodes respectively corresponding to nozzles determined not to eject the ink by the pulse generator, the second pulse pattern having a second potential which does not cause each of the plurality of nozzles to eject the ink; and a memory that stores a plurality of kinds of pulse patterns which respectively correspond to a plurality of kinds of gray scale levels, wherein the pulse generator determines the first pulse patterns by selecting one of the plurality of kinds of patterns stored in the memory based on the gray scale information in the image data, wherein the pulse generator determines the second pulse pattern based on the plurality of kinds of pulse patterns stored in the memory, and wherein the second pulse pattern is determined based on the densest gray scale level of gray scale levels of pixels in the image data.

2. The inkjet head printing device according to claim 1, wherein a number of pulses contained in each of the first pulse patterns and a number of pulses contained in the second pulse pattern are determined based on the gray scale information in the image data.

3. The inkjet head printing device according to claim 1, wherein at least one of a number of pulses contained in the second pulse pattern, a cycle of a pulse contained in the second pulse pattern, and a phase of the pulse contained in the second pulse pattern is the same as that of one of the first pulse patterns.

4. The inkjet head printing device according to claim 1, wherein at least one of a number of pulses, a cycle of a pulse and a phase of the pulse in the second pulse pattern is predetermined.

5. The inkjet head printing device according to claim 1, wherein the second pulse pattern is equal to one of the plurality of kinds of pulse patterns corresponding to the densest gray scale level of gray scale levels of the plurality of kinds of pulse patterns.

6. The inkjet head printing device according to claim 1, wherein the pulse generator determines a plurality of second pulse patterns, each having the second potential, for applying to all of the nozzles determined not to eject the ink.

7. The inkjet head printing device according to claim 1, wherein the pulse generator determines a plurality of second pulse patterns, each having the second potential, for applying to the nozzles which are determined not to eject the ink and which adjoin to one of the nozzles determined to eject the ink.

8. The inkjet head printing device according to claim 7, wherein one of the second pulse patterns for one of the nozzles determined not to eject the ink is determined based on neighboring nozzles which are determined to eject the ink and which adjoin to the one of the nozzles determined not to eject the ink.

9. The inkjet head printing device according to claim 8, wherein the one of the second pulse patterns for the one of the nozzles determined not to eject the ink is determined by considering gray scale levels for all of the neighboring nozzles.

10. The inkjet head printing device according to claim 9, wherein the one of the second pulse patterns for the one of the nozzles determined not to eject the ink is determined in accordance with a densest gray scale level of gray scale levels of the neighboring nozzles.

11. The inkjet head printing device according to claim 8, wherein the one of the second pulse patterns for the one of the nozzles determined not to eject the ink is determined based on a portion of the neighboring nozzles having a certain positional relationship with the one of the nozzles determined not to eject the ink.

12. The inkjet head printing device according to claim 8, wherein the one of the second pulse patterns for the one of the nozzles determined not to eject the ink is determined based on a portion of the neighboring nozzles situated in a certain direction with respect to the one of the nozzles determined not to eject the ink.

13. The inkjet head printing device according to claim 12, wherein the certain direction is a direction in which an effect of a structural crosstalk from the one of the nozzles determined not to eject the ink becomes greatest.

14. An inkjet head printing device, comprising:

an inkjet head that has an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles;

a pulse generator that determines first pulse patterns to be applied to electrodes respectively corresponding to nozzles which are to eject the ink, each of the first pulse patterns having a number of pulses based on gray scale information of an image to be formed, each of the first pulse patterns having a first potential which causes each of the plurality of nozzles to eject the ink, the pulse generator further determining a second pulse pattern to be applied to at least one of electrodes respectively corresponding to nozzles which are not to eject the ink, the second pulse pattern having a second potential which does not cause each of the plurality of nozzles to eject the ink, a phase and a cycle of the second pulse pattern being the same as those of one of the first pulse patterns;

a pulse supplying unit that supplies the electrodes respectively corresponding to the nozzles which are to eject the ink with the first pulse patterns, respectively, and supplies the at least one of electrodes respectively corresponding to nozzles which are not to eject the ink with the second pulse pattern; and a memory that stores a plurality of kinds of pulse patterns which respectively correspond to a plurality of kinds of gray scale levels, wherein the pulse generator determines the first pulse patterns by selecting one of the plurality of kinds of patterns stored in the memory based on the gray scale information in the image data, wherein the pulse generator determines the second pulse pattern based on the plurality of kinds of pulse patterns stored in the memory, and wherein the second pulse pattern is determined based on the densest gray scale level of gray scale levels of pixels in the image data.

15. An inkjet head printing device, comprising:

an inkjet head that has an ink flow channel unit including a plurality of nozzles for ejecting ink, a plurality of ink flow channels respectively provided for the plurality of nozzles and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles;

a pulse generator that determines whether each of the plurality of ink flow channels ejects the ink or not, and determines an amount of ink to be ejected from each of the plurality of ink flow channels based on gray scale information in image data to be formed, wherein the pulse generator determines first pulse patterns to be applied to electrodes respectively corresponding to ink flow channels determined to eject the ink by the pulse generator, the first pulse patterns respectively corresponding to amounts of ink of the ink flow channels determined to eject the ink by the pulse generator, each of the first pulse patterns having a first potential which causes each of the plurality of ink flow channels to eject the ink, and wherein the pulse generator determines a second pulse pattern to be applied to at least one of electrodes respectively corresponding to ink flow channels determined not to eject the ink by the pulse generator, the second pulse pattern having a second potential which does not cause each of the plurality of ink flow channels to eject the ink; and a memory that stores a plurality of kinds of pulse patterns which respectively correspond to a plurality of kinds of gray scale levels, wherein the pulse generator determines the first pulse patterns by selecting one of the plurality of kinds of patterns stored in the memory based on the gray scale information in the image data, wherein the pulse generator determines the second pulse pattern based on the plurality of kinds of pulse patterns stored in the memory, and wherein the second pulse pattern is determined based on the densest gray scale level of gray scale levels of pixels in the image data.

16. A method of driving an inkjet head of an inkjet head printing device, the inkjet head having an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles, the method comprising the steps of:

determining whether each of the plurality of nozzles ejects the ink or not, and determining an amount of ink to be ejected from each of the plurality o nozzle based on gray scale information in image data to be formed;

generating first pulse patterns to be applied to electrodes respectively corresponding to nozzles determined to eject the ink by the determining step, the first pulse patterns respectively corresponding to amounts of ink of the nozzles determined to eject the ink, each of the first pulse patterns having a first potential which causes each of the plurality of nozzles to eject the ink;

generating a second pulse pattern to be applied to at least one of electrodes respectively corresponding to nozzles determined not to eject the ink by the determining step, the second pulse pattern having a second potential which does not cause each of the plurality of nozzles to eject the ink; and storing a plurality of kinds of pulse patterns which respectively correspond to a plurality of kinds of gray scale levels, wherein the first pulse patterns is determined by selecting one of the plurality of kinds of patterns stored based on the gray scale information in the image data, wherein the second pulse pattern is determined based on the plurality of kinds of pulse patterns stored, and wherein the second pulse pattern is determined based on the densest gray scale level of gray scale levels of pixels in the image data.

17. The method according to claim 16, wherein a number of pulses contained in each of the first pulse patterns and a number of pulses contained in the second pulse pattern are determined based on the gray scale information in the image data.

18. The method according to claim 16, wherein at least one of a number of pulses contained in the second pulse pattern, a cycle of a pulse contained in the second pulse pattern, and a phase of the pulse contained in the second pulse pattern is the same as that of one of the first pulse patterns.

19. A method of driving an inkjet head of an inkjet head printing device, the inkjet head having an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles, the method comprising the steps of:

determining whether each of the plurality of nozzles ejects the ink or not, and determining an amount of ink to be ejected from each of the plurality of nozzles based on gray scale information in image data to be formed;

generating first pulse patterns to be applied to electrodes respectively corresponding to nozzles determined to eject the ink by the determining step, the first pulse patterns respectively corresponding to amounts of ink of the nozzles determined to eject the ink, each of the first pulse patterns having a first potential which causes each of the plurality of nozzles to eject the ink;

determining whether each of the nozzles determined not to eject the ink adjoins to at least one nozzle determined to eject the ink; and when one of the nozzles determined not to eject the ink adjoins to the at least one nozzle determined to eject the ink, generating a second pulse pattern to be applied to one of the electrodes corresponding to the one of the nozzles determined not to eject the ink in accordance with a densest gray scale level of gray scale levels of the at least one nozzle determined to eject the ink, the second pulse pattern having a second potential which does not cause each of the plurality of nozzles to eject the ink.

20. A computer program product comprising a computer program to be executed by a computer to achieve a method of driving an inkjet head of an inkjet head printing device, the inkjet head having an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles, the method comprising the steps of:

determining whether each of the plurality of nozzles ejects the ink or not, and determining an amount of ink to be ejected from each of the plurality of nozzle based on gray scale information in image data to be formed;

generating first pulse patterns to be applied to electrodes respectively corresponding to nozzles determined to eject the ink by the determining step, the first pulse patterns respectively corresponding to amounts of ink of the nozzles determined to eject the ink, each of the first pulse patterns having a first potential which causes each of the plurality of nozzles to eject the ink;

generating a second pulse pattern to be applied to at least one of electrodes respectively corresponding to nozzles determined not to eject the ink by the determining step, the second pulse pattern having a second potential which does not cause each of the plurality of nozzles to eject the ink; and storing a plurality of kinds of pulse patterns which respectively correspond to a plurality of kinds of gray scale levels, wherein the first pulse patterns is determined by selecting one of the plurality of kinds of patterns stored based on the gray scale information in the image data, wherein the second pulse pattern is determined based on the plurality of kinds of pulse patterns stored, and wherein the second pulse pattern is determined based on the densest gray scale level of gray scale levels of pixels in the image data.

21. The computer program product according to claim 20, wherein a number of pulses contained in each of the first pulse patterns and a number of pulses contained in the second pulse pattern are determined based on the gray scale information in the image data.

22. The computer program product according to claim 20, wherein at least one of a number of pulses contained in the second pulse pattern, a cycle of a pulse contained in the second pulse pattern, and a phase of the pulse contained in the second pulse pattern is the same as that of one of the first pulse patterns.

23. A computer program product comprising a computer program to be executed by a computer to achieve a method of driving an inkjet head of an inkjet head printing device, the inkjet head having an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles, the method comprising the steps of:

determining whether each of the plurality of nozzles ejects the ink or not, and determining an amount of ink to be ejected from each of the plurality of nozzles based on gray scale information in image data to be formed;

generating first pulse patterns to be applied to electrodes respectively corresponding to nozzles determined to eject the ink by the determining step, the first pulse patterns respectively corresponding to amounts of ink of the nozzles determined to eject the ink, each of the first pulse patterns having a first potential which causes each of the plurality of nozzles to eject the ink;

determining whether each of the nozzles determined not to eject the ink adjoins to at least one nozzle determined to eject the ink; and when one of the nozzles determined not to eject the ink adjoins to the at least one nozzle determined to eject the ink, generating a second pulse pattern to be applied to one of the electrodes corresponding to the one of the nozzles determined not to eject the ink in accordance with a densest gray scale level of gray scale levels of the at least one nozzle determined to eject the ink, the second pulse pattern having a second potential which does not cause each of the plurality of nozzles to eject the ink.

24. An inkjet head printing device, comprising:

an inkjet head that has an ink flow channel unit including a plurality of nozzles for ejecting ink and a plurality of pressure chambers respectively provided for the plurality of nozzles, and a piezoelectric actuator unit including a piezoelectric sheet, a plurality of electrodes and a common electrode, the plurality of electrodes being respectively located oppositely to the plurality of pressure chambers, each of the plurality of electrodes applies a voltage to the piezoelectric sheet to change a volumetric capacity of corresponding one of the plurality of pressure chambers and to eject ink from corresponding one of the plurality of nozzles;

a pulse generator that determines whether each of the plurality of nozzles ejects the ink or not, and determines an amount of ink to be ejected from each of the plurality of nozzles based on gray scale information in image data to be formed, wherein the pulse generator determines first pulse patterns to be applied to electrodes respectively corresponding to nozzles determined to eject the ink by the pulse generator, the first pulse patterns respectively corresponding to amounts of ink of the nozzles determined to eject the ink by the pulse generator, each of the first pulse patterns having a first potential which causes each of the plurality of nozzles to eject the ink, and wherein the pulse generator determines a second pulse pattern to be applied to at least one of electrodes respectively corresponding to nozzles determined not to eject the ink by the pulse generator, the second pulse pattern having a second potential which does not cause each of the plurality of nozzles to eject the ink; and a memory that stores a plurality of kinds of pulse patterns which respectively correspond to a plurality of kinds of gray scale levels, wherein the pulse generator determines the first pulse patterns by selecting one of the plurality of kinds of patterns stored in the memory based on the gray scale information in the image data, wherein the pulse generator determines the second pulse pattern based on the plurality of kinds of pulse patterns stored in the memory, wherein the pulse generator determines a plurality of second pulse patterns, each having the second potential, for applying to the nozzles which are determined not to eject the ink and which adjoin to one of the nozzles determined to eject the ink, wherein one of the second pulse patterns for one of the nozzles determined not to eject the ink is determined based on neighboring nozzles which are determined to eject the ink and which adjoin to the one of the nozzles determined not to eject the ink, wherein the one of the second pulse patterns for the one of the nozzles determined not to eject the ink is determined by considering gray scale levels for all of the neighboring nozzles, and wherein the one of the second pulse patterns for the one of the nozzles determined not to eject the ink is determined in accordance with a densest gray scale level of gray scale levels of the neighboring nozzles.

* * * * *